US008033335B2

(12) United States Patent
Orbell et al.

(10) Patent No.: US 8,033,335 B2
(45) Date of Patent: Oct. 11, 2011

(54) OFFSHORE UNIVERSAL RISER SYSTEM

(75) Inventors: Charles R. Orbell, Melbourne Beach, FL (US); Christian Leuchtenberg, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 710 days.

(21) Appl. No.: 11/936,411

(22) Filed: Nov. 7, 2007

(65) Prior Publication Data

US 2008/0105434 A1 May 8, 2008

Related U.S. Application Data

(60) Provisional application No. 60/864,712, filed on Nov. 7, 2006.

(51) Int. Cl.
*E21B 17/01* (2006.01)
*E21B 7/12* (2006.01)

(52) U.S. Cl. ..... 166/367; 166/339; 166/344; 166/352; 166/360; 166/268; 175/5; 175/7; 175/48; 175/212

(58) Field of Classification Search ..... 166/367, 166/360, 359, 344, 345, 338, 401, 257, 261, 166/266, 268, 339, 351, 352, 381, 75.15; 175/5, 7, 75.15, 25, 38, 48, 212, 218
See application file for complete search history.

(56) References Cited

U.S. PATENT DOCUMENTS 3,603,409 A * 9/1971 Watkins ..... 175/7
4,046,191 A * 9/1977 Neath ..... 166/352
4,063,602 A * 12/1977 Howell et al. ..... 175/7
4,099,583 A * 7/1978 Maus ..... 175/7
4,291,772 A * 9/1981 Beynet ..... 175/5
4,468,056 A 8/1984 Kramer et al.
4,626,135 A 12/1986 Roche
4,813,495 A 3/1989 Leach
5,006,845 A * 4/1991 Calcar et al. ..... 367/81
5,720,356 A 2/1998 Gardes (Continued)

FOREIGN PATENT DOCUMENTS

EP 1071862 1/2001

(Continued)

OTHER PUBLICATIONS

International Search Report and Written Opinion issued Feb. 12, 2009, for International Patent Application No. PCT/US08/87686, 7 pages.

(Continued)

*Primary Examiner* — Thomas Beach
*Assistant Examiner* — Matthew Buck
(74) *Attorney, Agent, or Firm* — Smith IP Services, P.C.

(57) ABSTRACT

An offshore universal riser system (OURS) and injection system (OURS-IS) inserted into a riser. The OURS/OUR-IS provides a means for pressurizing the marine riser to its maximum pressure capability and easily allows variation of the fluid density in the riser. The OURS-IS includes a riser pup joint with provision for injecting a fluid into the riser with isolation valves. The OURS includes a riser pup joint with an inner riser adapter, a pressure test nipple, a safety device, outlets with valves for diverting the mud flow, nipples with seal bores for accepting RCDs. The easy delivery of fluids to the OURS-IS is described. A method is detailed to manipulate the density in the riser to provide a wide range of operating pressures and densities enabling the concepts of Managed Pressure Drilling, Dual Density Drilling or Dual Gradient Drilling, and Underbalanced Drilling.

20 Claims, 15 Drawing Sheets

U.S. PATENT DOCUMENTS 5,771,974 A 6/1998 Stewart et al.
6,053,252 A 4/2000 Edwards
6,065,550 A 5/2000 Gardes
6,102,673 A 8/2000 Mott et al.
6,138,774 A * 10/2000 Bourgoyne et al. ..... 175/7
6,230,824 B1 5/2001 Peterman et al.
6,263,982 B1 7/2001 Hannegan et al.
6,273,193 B1 8/2001 Hermann et al.
6,325,159 B1 12/2001 Peterman et al.
6,328,107 B1 12/2001 Maus
6,450,262 B1 9/2002 Regan
6,454,022 B1 9/2002 Sangesland et al.
6,457,540 B2 10/2002 Gardes
6,470,975 B1 10/2002 Bourgoyne et al.
6,527,062 B2 3/2003 Elkins et al.
6,571,873 B2 6/2003 Maus
6,598,682 B2 7/2003 Johnson et al.
6,668,943 B1 * 12/2003 Maus et al. ..... 175/5
6,702,012 B2 * 3/2004 Bailey et al. ..... 166/84.4
6,732,798 B2 5/2004 Johnson et al.
6,732,804 B2 5/2004 Hosie et al.
6,739,397 B2 5/2004 Ayling
6,745,857 B2 6/2004 Gjedebo
6,802,379 B2 * 10/2004 Dawson et al. ..... 175/38
6,814,140 B2 * 11/2004 Robichaux ..... 166/77.4
6,840,322 B2 1/2005 Haynes et al.
6,904,981 B2 6/2005 Van Riet
6,913,092 B2 7/2005 Bourgoyne et al.
6,920,085 B2 7/2005 Finke et al.
6,981,561 B2 1/2006 Krueger et al.
7,023,691 B1 4/2006 Feight et al.
7,032,691 B2 4/2006 Humphreys
7,040,394 B2 * 5/2006 Bailey et al. ..... 166/84.4
7,044,237 B2 5/2006 Leuchtenberg
7,055,627 B2 6/2006 Fontana et al.
7,073,591 B2 7/2006 Massie et al.
7,080,685 B2 7/2006 Bailey et al.
7,090,036 B2 * 8/2006 deBoer ..... 175/70
7,093,662 B2 8/2006 De Boer
7,096,975 B2 8/2006 Aronstam et al.
7,114,571 B2 * 10/2006 Gatherar et al. ..... 166/367
7,134,489 B2 11/2006 Van Riet
7,158,886 B2 1/2007 Hou et al.
7,159,669 B2 1/2007 Bourgoyne et al.
7,174,975 B2 2/2007 Krueger et al.
7,185,718 B2 3/2007 Gardes
7,185,719 B2 3/2007 Van Riet
7,258,171 B2 8/2007 Bourgoyne et al.
7,264,058 B2 9/2007 Fossli
7,270,185 B2 9/2007 Fontana et al.
7,278,496 B2 10/2007 Leuchtenberg
7,350,597 B2 4/2008 Reitsma et al.
7,353,887 B2 4/2008 Krueger et al.
7,367,410 B2 5/2008 Sangesland
7,367,411 B2 5/2008 Leuchtenberg
7,395,878 B2 7/2008 Reitsma et al.
7,487,837 B2 * 2/2009 Bailey et al. ..... 166/345
7,497,266 B2 3/2009 Fossli
7,513,310 B2 4/2009 Fossli
7,562,723 B2 7/2009 Reitsma
7,650,950 B2 1/2010 Leuchtenberg
7,658,228 B2 2/2010 Moksvold
7,677,329 B2 3/2010 Stave
7,699,109 B2 * 4/2010 May et al. ..... 166/367
7,708,064 B2 5/2010 Sehsah
7,721,822 B2 5/2010 Krueger et al.
7,806,203 B2 10/2010 Krueger et al.
7,926,593 B2 * 4/2011 Bailey et al. ..... 175/87
2002/0112888 A1 8/2002 Leuchtenberg
2003/0066650 A1 4/2003 Fontana et al.
2003/0089498 A1 5/2003 Johnson et al.
2003/0098181 A1 5/2003 Aronstam et al.
2003/0111799 A1 6/2003 Gilmore
2003/0127230 A1 * 7/2003 von Eberstein et al. ..... 166/337
2004/0124008 A1 7/2004 Fincher et al.
2004/0206548 A1 10/2004 Aronstam et al.
2005/0061546 A1 3/2005 Hannegan
2005/0092522 A1 5/2005 Humphreys
2006/0021755 A1 2/2006 Radi et al.
2006/0065402 A9 3/2006 Fontana et al.
2006/0070772 A1 4/2006 De Boer et al.
2006/0086538 A1 4/2006 Van Riet
2006/0102387 A1 5/2006 Bourgoyne et al.
2006/0124300 A1 6/2006 Steiner et al.
2006/0169491 A1 8/2006 Fossli
2006/0185857 A1 8/2006 York et al.
2006/0191716 A1 8/2006 Humphreys
2007/0068704 A1 3/2007 Krueger et al.
2007/0240875 A1 10/2007 Van Riet
2007/0278007 A1 12/2007 Krueger et al.
2009/0139724 A1 * 6/2009 Gray et al. ..... 166/345
2009/0211239 A1 8/2009 Askeland
2010/0006297 A1 1/2010 Stave
2010/0018715 A1 * 1/2010 Orbell et al. ..... 166/337

FOREIGN PATENT DOCUMENTS

EP 1240404 9/2002
EP 1432887 B1 3/2003
EP 1488073 B1 8/2003
EP 1356186 10/2003
EP 1595057 B1 9/2004
EP 1664478 B1 2/2005
EP 1659260 A2 * 5/2006
EP 2053196 A1 4/2009
GB 2229787 A 10/1990
WO 01/65060 9/2001
WO 02/50398 6/2002
WO 2005/042917 5/2005
WO 2007/008085 1/2007

OTHER PUBLICATIONS

International Preliminary Report on Patentability issued May 22, 2009, for International Patent Application Serial No. PCT/US07/83974, 13 pages.
International Search Report and Written Opinion issued Sep. 22, 2008, for International Patent Application No. PCT/US07/83974, 16 pages.
Examination Report issued Oct. 5, 2010, for AU Patent Application Serial No. 2007317276, 2 pages.
Written Opinion issued May 17, 2010, for SG Patent Application Serial No. 2009030222, 2 pages.
Examiner's Report issued Mar. 7, 2011, for AU Patent Application No. 2007317276, 2 pages.
Office Action issued Feb. 15, 2011, for Singapore Patent Application No. 200903022-2, 9 pages.
US 6,708,780, 03/2004, Bourgoyne et al. (withdrawn)

* cited by examiner

OFFSHORE UNIVERSAL RISER SYSTEM

CROSS-REFERENCE TO RELATED APPLICATIONS

The present application claims the benefit under 35 USC 119(e) of the filing date of provisional application No. 60/864,712 filed on Nov. 7, 2006. The entire disclosure of this prior provisional application is incorporated herein by this reference.

STATEMENT REGARDING FEDERALLY SPONSORED RESEARCH OR DEVELOPMENT

Not Applicable.

BACKGROUND

Risers are used in offshore drilling applications to provide a means of returning the drilling fluid and any additional solids and/or fluids from the borehole back to surface.

Riser sections are sturdily built as they have to withstand significant loads imposed by the weights they have to carry and the environmental loads they have to withstand when in operation. As such they have an inherent internal pressure capacity. However, this capacity is not currently exploited to the maximum possible. Many systems have been proposed to vary the density of fluid in the riser but none have provided a universally applicable and easily deliverable system for varying types of drilling modes. They all require some specific modification of the main components of a floating drilling installation with the result that they are custom solutions with a narrow range of application due to the costs and design limitations. For example, different drilling systems are required for different drilling modes such as managed pressure drilling, dual density or dual gradient drilling, partial riser level drilling, and underbalanced drilling.

An example of the most common current practice is illustrated by FIG. 1, which is proposed in U.S. Pat. No. 4,626,135 assigned on its face to the Hydril Company. To compensate for movement of the floating drilling installation a slip joint SJ (telescopic joint) is introduced. This slip joint consist of an inner barrel IB and an outer barrel OB that move relative to each other, thus allowing the floating structure S to move without breaking the riser R between the fixed point well W and the moving point D, which is the diverter where the top of the riser returns the drilling fluid. A ball joint BJ (also called and designed as a flex-joint) provides for some angular displacement of the riser from vertical. The conventional method sees any pressure in the riser R due to flow of pressurized fluids from well W as an uncontrolled event (kick) that is controlled by closing the BOP (Blow Out Preventer) either by rams around the tubulars, or by blind rams if no tubulars present or by shear rams capable of cutting the tubulars. It is possible for the kick to enter the riser R and then it is controlled by closing the diverter D (with or without tubulars present) and diverting the undesired flow through diverter lines DL. In the U.S. Pat. No. 4,626,135 patent Hydril introduces the concept of an annular blow out preventer used as a gas handler to divert the flow of gas from a well control incident. This allows diversion of gas by closing around the tubulars in hole, but not when drilling, i.e., rotating the tubular.

In FIG. 1 the seals between the outer barrel OB and inner barrel IB are subjected to much movement due to wave motion and this has led to a limitation of the pressure sealing capacity available for the riser. In fact the American Petroleum Institute (API) has established pressure ratings for such seals in its specification 16F, which calls for testing to 200 psi. In practice the common upper limit for most designs is 500 psi. There are some modifications that can be made as shown in U.S. Patent Application No. US2003/0111799A1 assigned on the face to the Cooper Cameron Corporation which envisions a working rating to 750 psi. In practice the limitation on the slip joint seal has also led to an accepted standard in the industry of the diverter D, ball joint BJ (also sometimes replaced by a unit called flex-joint) and other parts of the system like the valves on the diverter line DL having an industry wide rating of 500 psi working pressure. The outer barrel OB of the slip joint SJ (telescopic joint) also acts as the attachment point for the tension system that serves to keep the riser R in tension to prevent it from buckling. This means that a leak on the slip joint SJ seals involves significant down time in having to lift the whole riser from the subsea BOP (Blow Out Preventer) and servicing the slip joint SJ. In practice it has meant that no floating drilling installation service provider or operating company has been willing to take the risk to continuously operate with any pressure in the riser for the conventional system as depicted again in FIG. 3*a*.

U.S. patent application Ser. No. US2005/0061546 and U.S. Pat. No. 6,913,092 assigned on their face to Weatherford/Lamb Inc. have addressed this problem by proposing the locking closed of the slip joint SJ, which means locking the inner barrel to the outer barrel, thus eliminating movement across the slip joint seal. The riser R is then effectively disconnected from the ball joint BJ and diverter D as shown in FIG. 2. The riser is closed by adding a rotating blowout preventer BOP on top of the locked closed slip joint SJ. This effectively decouples the riser R from any fixed point below the rotary table RT. This method has been used and allowed operations with a limit of 500 psi, the weak point still being the slip joint seals. However decoupling the riser R means that it is only held by the tensioner system T1 and T2. This means that the top of the riser is no longer self centralizing. This causes the top of the Rotating Control Device RCD to be off center as a result of the ocean currents, wind patterns, or movement of the floating structure. This introduces significant wear on the sealing element(s) of the RCD, which is detrimental to the pressure integrity of that system.

Also, the design introduces a significant safety hazard as now substantial amounts of easily damaged hydraulic hoses used in the operation of the RCD, as well as pressurized hose(s) DL and safety conduit SC, are introduced to the vicinity of the riser tensioner wires depicted as coming from the slip joint SJ to the sheaves at the bottom of the tensioners T1, T2. These wires are under substantial loads in the order of 50 to 100 tons each and can easily cut through softer rubber goods (hoses). The U.S. Pat. No. 6,913,092 patent suggests the use of steel pipes, but this is extremely difficult to achieve in practice. Also, the installation and operation involves personnel around the RCD, a hazardous area with the relative movement of the floating structure to the top of the riser. All of the equipment does not fit through the rotary table RT and diverter housing D, thus making installation complex and hazardous. Thus the use of this invention has been limited to operations in benign sea areas with little current, wave motion, and wind loads.

A summary of the evolution for the art for drilling with pressure in the riser is shown in FIGS. 3*a* to 3*c*. FIG. 3*a* shows the conventional floating drilling installation set-up. This consists typically of an 18¾ inch subsea BOP stack, with a LMRP (Lower Marine Riser Package) added to allow disconnection and prevent loss of fluids from the riser, a 21 inch riser, and a top configuration identical in principle to the U.S.

Pat. No. 4,626,135 patent. This is the configuration used by more than 80% of today's floating drilling installations. In order to reduce costs the industry moved towards the idea of using a SBOP (Surface Blow Out Preventer), with a floating drilling installation, U.S. Pat. No. 6,273,193 as illustrated in FIG. 4, where the 21 inch riser is replaced with a smaller high pressure riser capped with a SBOP package similar to a non-floating drilling installation set-up as illustrated in FIG. 3*b*. This design evolved to dispensing completely with the subsea BOP, thus removing the need for choke, kill, and other lines from the sea floor back to the floating drilling installation and over 160 wells were drilled like this in benign ocean areas. In attempting to take the concept of a SBOP and high pressure riser further into more environmentally harsh areas a subsea component for disconnection (as marketed by the Cameron corporation as the ESG system) and securing the well in case of emergency was re-introduced, but not as a full subsea BOP. This is shown in FIG. 3*c* with another evolution of running the SBOP below the water line and tensioners above to enable for heave on floating drilling installations with limited clearance. The method of U.S. Pat. No. 6,913,092 is shown in FIG. 3*d* for comparison. In trying to plan for substantially higher pressures as experienced in underbalanced drilling where the formation being drilled is allowed to flow with the drilling fluid to surface, the industry has favored designs utilizing an inner riser run within the typical 21 inch marine riser as described in U.S. Pat. App. 2006/0021755 A1. This requires a SBOP as shown in FIG. 3*e*. The drawback of all these systems is that they require substantial modification of the floating drilling installation to enable the use of SBOP (Surface Blow Out Preventers) and the majority are limited to benign sea and weather conditions. Thus they are not widely implemented as it requires the floating drilling installation to undergo modifications in a shipyard.

Methods and systems as shown in U.S. Pat. Nos. 6,230,824 B1 and 6,138,774 attempt to disperse totally with the marine riser. Methods and systems described in U.S. Pat. No. 6,450,262, U.S. Pat. No. 6,470,975, and U.S. Pat. App. 2006/0102387A1 envisions setting a RCD device on top of the subsea BOP to divert pressure from the marine riser as does U.S. Pat. No. 7,080,685 B2. All of these patents are not widely applied as they involve substantial modifications and additions to existing equipment to be successfully applied. FIG. 5 shows this as depicted in U.S. Pat. No. 6,470,975. The problem with the foregoing systems that utilize a high pressure riser or a riserless setup is that one of the primary means of delivering additional fluids to the seafloor, namely the booster line BL that is a typical part of the conventional system as depicted in FIG. 3*a* is removed. The booster line BL is also indicated in FIG. 1 and FIG. 2. So the systems shown in FIGS. 3*b* and 3*c*, while providing some advantages, take away one of the primary means of delivering fluid into the riser. Also the typical booster line BL is tied in to the base of the riser which means that the delivery point is fixed.

There is also an evolution in the industry to move from conventional drilling to closed system drilling. These types of closed systems are described in U.S. Pat. Nos. 6,904,981 and 7,044,237 and require the closure and by consequence the trapping of pressure inside the marine riser for floating drilling installations. This is schematically depicted in FIG. 6*b*, with FIG. 6*a* depicting the conventional system of FIG. 3*a* for comparison. Also the introduction of a method and system to allow continuous circulation as described in U.S. Pat. No. 6,739,397 allows a drilling circulation system to be operated at constant pressure as the pumps do not have to be switched off when making or breaking a tubular connection. This allows the possibility of drilling with a constant pressure downhole, which can be controlled by a pressurized closed drilling system. The industry calls this Managed Pressure Drilling. With the conventional method of FIG. 3*a*, no continuous pressure can be kept in the riser. With the method of the U.S. Pat. No. 6,913,092 patent in FIG. 3*d* the envelope has been taken to 500 psi, however with the substantial addition of hazards and many drawbacks. It is possible to increase the envelope by the methods shown in FIGS. 3*b*, 3*c* and 3*e*. However the addition of a SBOP (Surface BOP) to a floating drilling installation is not a normal design consideration and involves substantial modification usually involving a shipyard with the consequence of operational downtime as well as substantial costs involved, as already mentioned earlier. The system and method of this invention will enable all the systems shown in FIGS. 3*a* to 3*g* to be pressurized and to have the ability to inject fluids at any point into the riser. Furthermore any modification that lessens the normal operating envelope (i.e. weather, current, wave and storm survival capability) of the floating drilling installation leads to a limitation in use of that system. The systems shown in FIGS. 3*b*, 3*d*, 3*e*, and 3*g* all lessen this operating envelope, which is a major reason why these systems have not been applied in harsher environmental conditions. The system depicted in FIG. 3*c* does not lessen this operating window significantly, but it does not allow for an easy installation of a RCD. All of these limitations are eliminated by the present invention.

The systems mentioned earlier in U.S. Pat. Nos. 6,904,981 and 7,044,237 discuss closing the choke on a pressurized drilling system, and using manipulation of the choke to control the backpressure of the system, in order to control the pressure at the bottom of the well. This method works in principle, but in field applications of these systems, when drilling in a closed system, the manipulation of the choke can cause pressure spikes that are detrimental to the purpose of these inventions, i.e., precise control of the bottom hole pressure. Also, the peculiarity of a floating drilling installation is, that when a connection is made, the top of the pipe is held stationary in the rotary table (RT in FIG. 1 and FIG. 2). This means that the whole string of pipe in the wellbore now moves up and down as the wave action (known as heave in the industry) causes the pressure effects of surge (pressure increase as the pipe moves into the hole) and swab (pressure drop as the pipe moves out of the hole). This effect already causes substantial pressure variations in the conventional method of FIG. 3*a*. When the system is closed by the addition of a RCD as shown in FIG. 3*d*, this effect is even more pronounced by the effect of volume changes by the pipe moving in and out of a fixed volume. As the movement of a pressure wave in a compressed liquid is the speed of sound in that liquid, it implies that the choke system would have to be able to respond at the same or even faster speed. While the electronic sensor and control systems are able to achieve this, the mechanical manipulation of the choke system is very far from these speeds. In order to reduce, or even optimally remove these pressure spikes (negative or positive from the desired baseline), a damping system is required. The best damping system in an incompressible fluid system is the introduction of a compressible fluid in direct contact with the incompressible fluid. This could be a gas, e.g., Nitrogen.

The RCD (Rotating Control Devices) development originated from land operations where typically the installation was on top of the BOP (Blow Out Preventer). This meant that usually there was no further equipment installed above the RCD. As access was easy, almost all of the current designs have hydraulic connections for lubricating and cooling the bearing or for other utilities. These require the attachment of hoses for operation. Although some versions have progressed from surface type to being adapted for use on the bottom of the sea as described in U.S. Pat. No. 6,470,975 they fail to disclose a complete system for achieving this. Some systems as described in U.S. Pat. No. 7,080,685 disperse with hydraulic cooling and lubrication, but require a hydraulic connection to release the assembly. A complete system would require a latching mechanism; that also allows transfer of the hydraulic connections from the outside of the riser to the inside of the riser, and vice versa, so as to remove any hydraulic action or hoses internal to the riser. Furthermore the range of RCDs and possibilities available means that it requires a custom made unit to house a particular RCD design as described U.S. Pat. No. 7,080,685. The U.S. Pat. No. 7,080,685 provides only for a partial removal of the RCD assembly, leaving the body on location.

Many ideas and patents have been filed, but the field application of technology to solve some of the shortcomings in the conventional set-up of FIG. 3*a* has been limited. All of them modify the existing system in a custom manner taking away some of the flexibility. There exists a gap in the present industry to provide a solution to allow running a pressurized riser for the majority of floating drilling installations to allow closed system drilling techniques, especially Managed Pressure Drilling to be safely and expediently applied without any major modification to the floating drilling installation.

These requirements are:

(1) Be able to pressurize the marine riser to the maximum pressure capacity of its members;

(2) Be able to be safely installed using normal operational practices and operated as part of marine riser without any floating drilling installation modifications as required for surface BOP operations or some subsea ideas;

(3) Provide full-bore capability like a normal marine riser section when required;

(4) Provide the ability to use the standard operating procedures when not in pressurized mode;

(5) Does not lessen the weather (wind, current and wave) operating window of the floating drilling installation;

(6) Provide a means for damping the pressure spikes caused by heave resulting in surge and swab fluctuations;

(7) Provide a means for eliminating the pressure spikes caused by movement of the rotatable tubulars into and out of a closed system; and (8) Provide a means for easily modifying the density of fluid in the riser at any desired point.

BRIEF DESCRIPTION OF THE DRAWINGS

For a more detailed description of the embodiments, reference will now be made to the following accompanying drawings:

FIG. 3 schematically depicts the different systems in use today, specifically where:

DETAILED DESCRIPTION OF THE EMBODIMENTS

Figure 1:
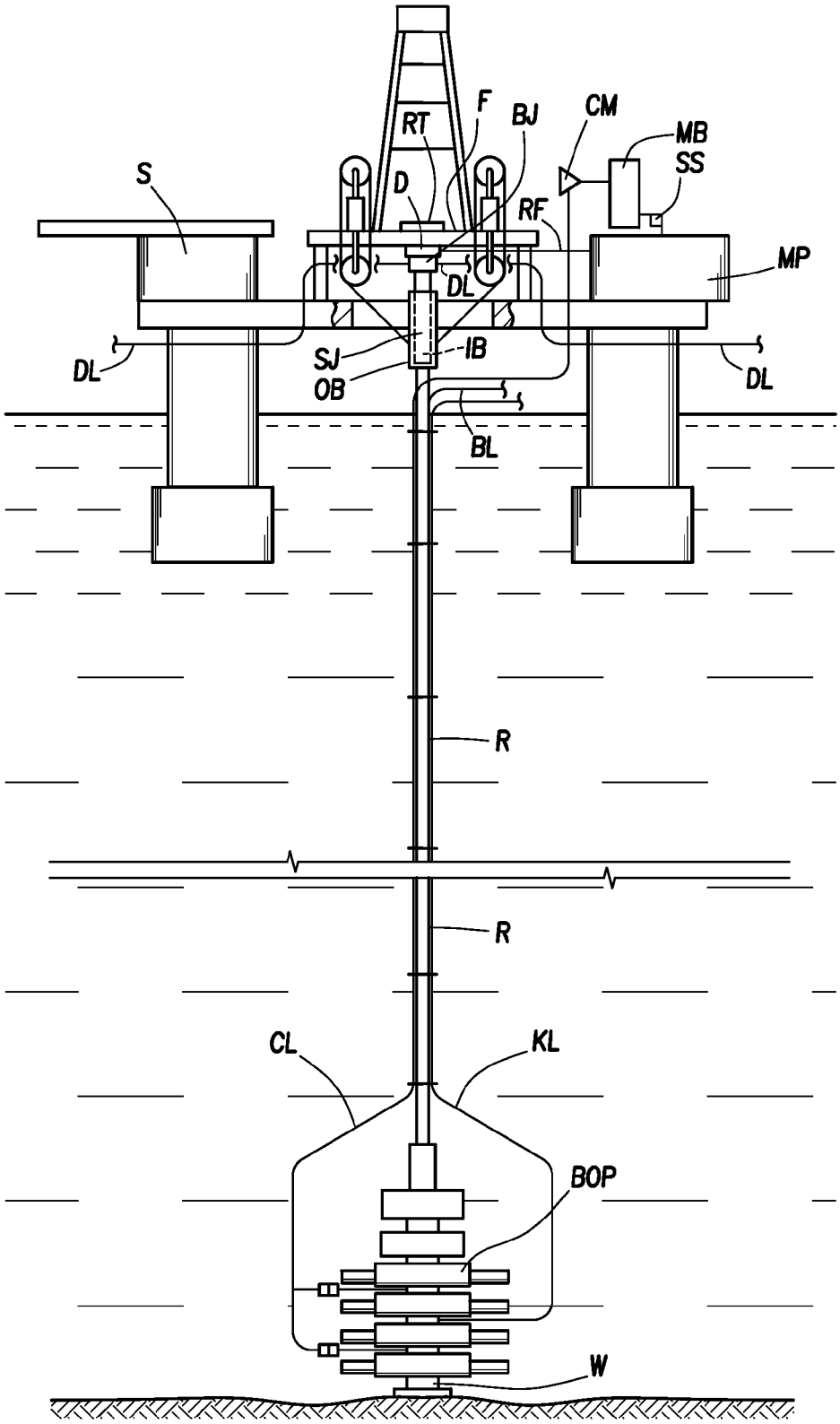
FIG. 1 (PRIOR ART)
FIG. 1 is an elevation view of a prior art floating drilling installation with a conventional mud return system shown in broken view.
Figure 2:
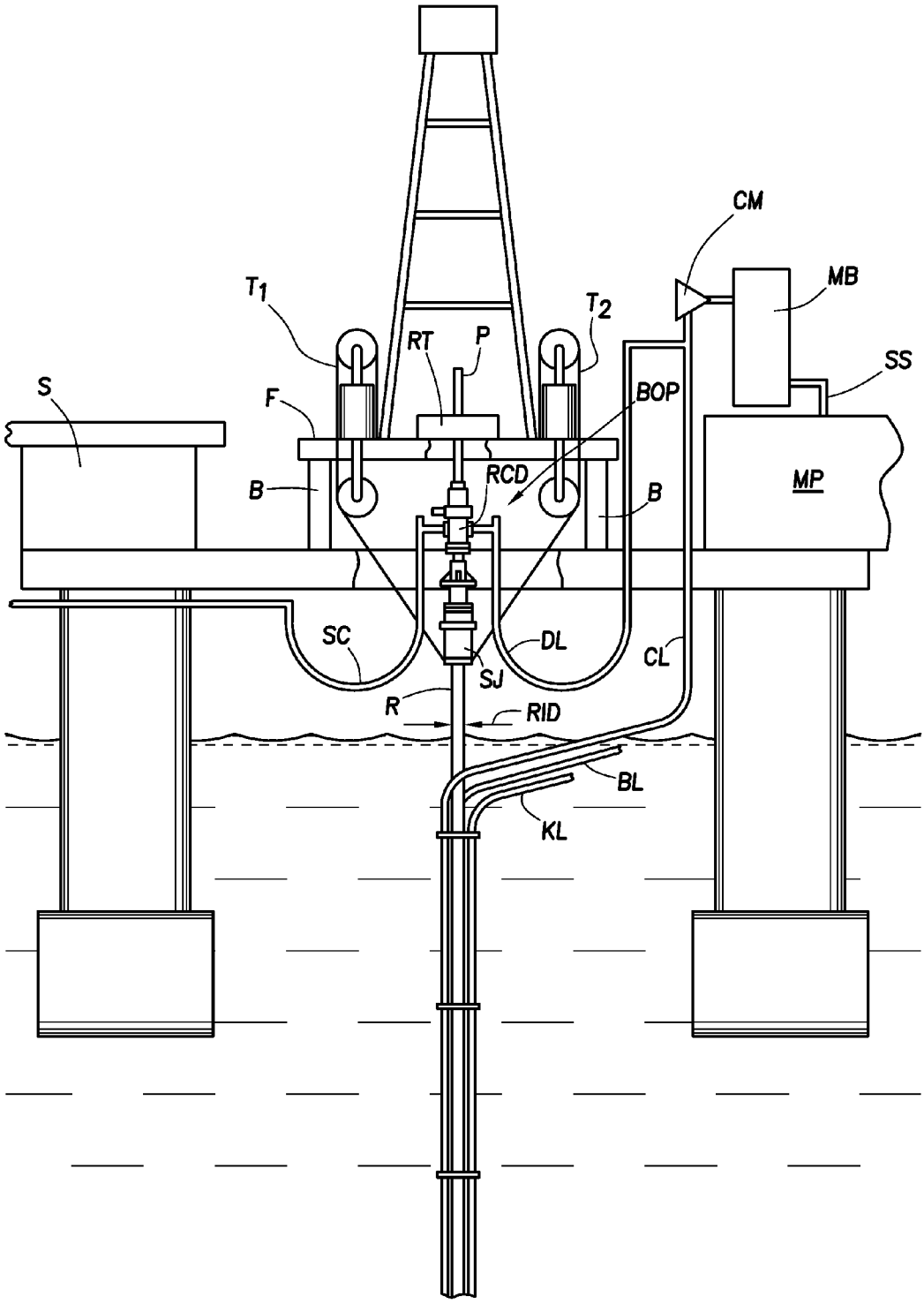
FIG.2 (PRIOR ART)
FIG. 2 is an elevation view of a prior art floating drilling installation that locks closed the slip joint and then by way of a rotating control device keeps the riser under pressure and diverts the flow of mud through hoses into the mud pit. The riser is disconnected from the ball joint.

In the drawings and description that follows, like parts are marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. The present invention is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results. Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

An offshore universal riser system (OURS) is disclosed for drilling deepwater in the floor of the ocean using rotatable tubulars. The OURS uses a universal riser section that is normally placed at the top of the riser below the slip joint in a subsea riser system. The OURS includes: a seal bore to take an inner riser string (if present) with a vent for outer riser, a nipple to receive pressure test adapters, an inlet/outlet tied into the riser choke line, kill line or booster line(s) as required, one or more integral Blow Out Preventers as safety devices, outlet(s) for pressurized mud return with a valve(s), an optional outlet for riser overpressure protection, one or more seal bores with adapters that can accept a variety of RCD designs, a provision for locking said RCD(s) in place, a seal bore adapter to allow all RCD utilities to be transferred from internal to external and vice versa. Externally, the universal riser section includes all the usual riser connections and attachments required for a riser section. Additionally OURS includes provision for mounting an accumulator(s), provision for accepting instrumentation for measuring pressure, temperature and any other inputs or outputs, e.g., riser level indicators; a line(s) taking pressurized mud to the next riser section above or slip joint; Emergency Shut Down system(s) and remote operated valve(s); a hydraulic bundle line taking RCD utilities and controls; an electric bundle line for instrumentation or other electrical requirements. A choking system may also be inserted in the mud return line that is capable of being remotely and automatically controlled. The OURS may also include a second redundant return line if required. As part of the system, when required, a lower riser section coupled with a composite hose (or other delivery system) for delivery of fluids (OURS-IS) may be included with an inlet to allow injection of a different density fluid into the riser at any point between the subsea BOP and the top of the riser. This allows the injection into the riser of Nitrogen or Aphrons (glass spheres), or fluids of various densities that will allow hydrostatic variations to be applied to the well, when used in conjunction with a surface or sub surface choke.

Figure 3A:
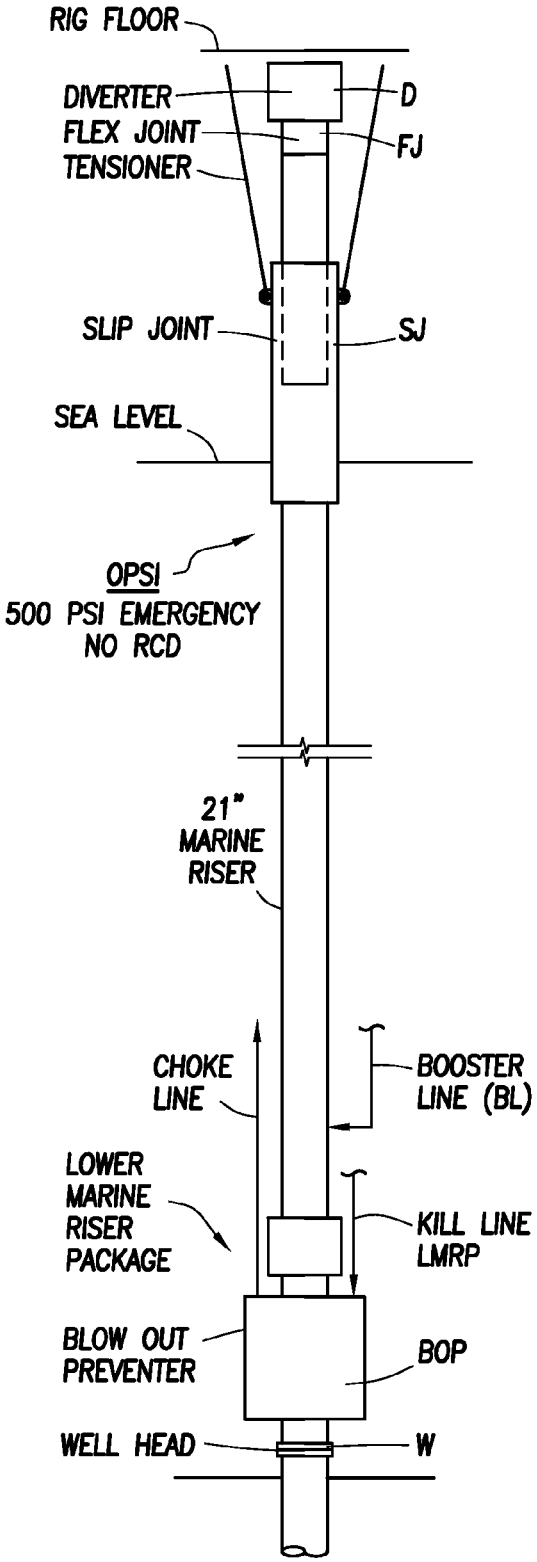
FIG. 3*a* is the conventional system most commonly used today by over 90% of floating drilling installations.
Figure 3B:
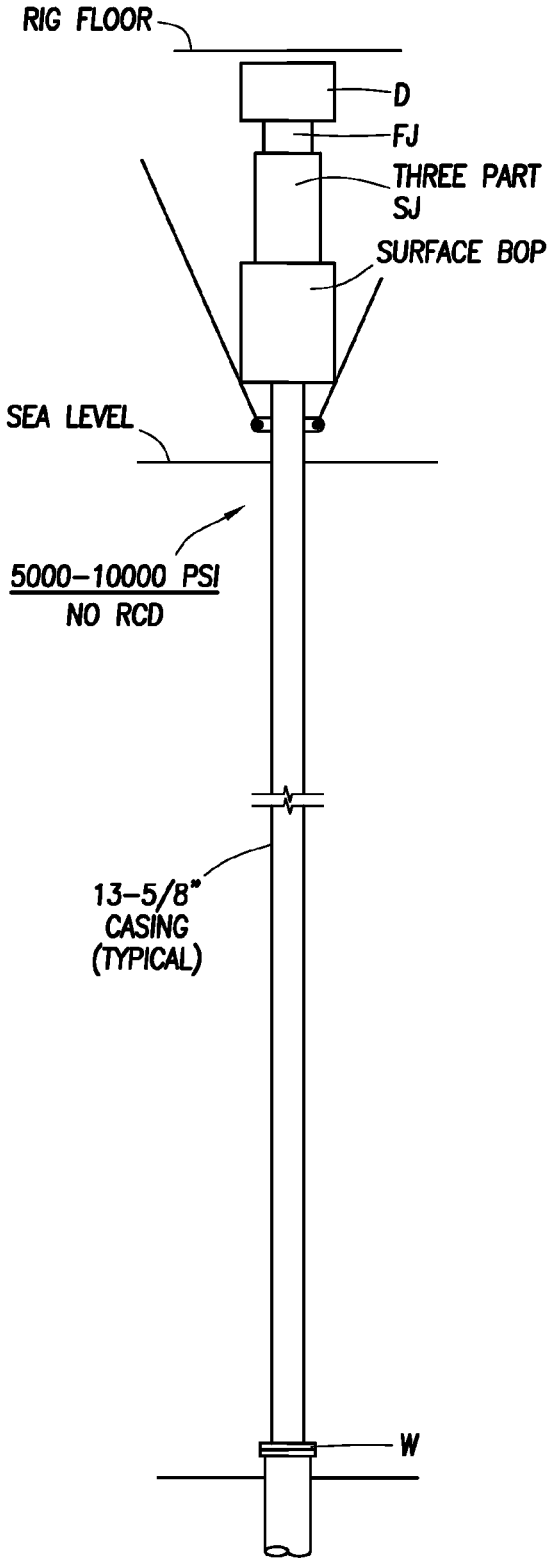
FIG. 3*b* is showing the drilling with a high pressure casing riser and surface BOP, which as been used for about 200 wells but limited to benign sea areas.
Figure 3C:
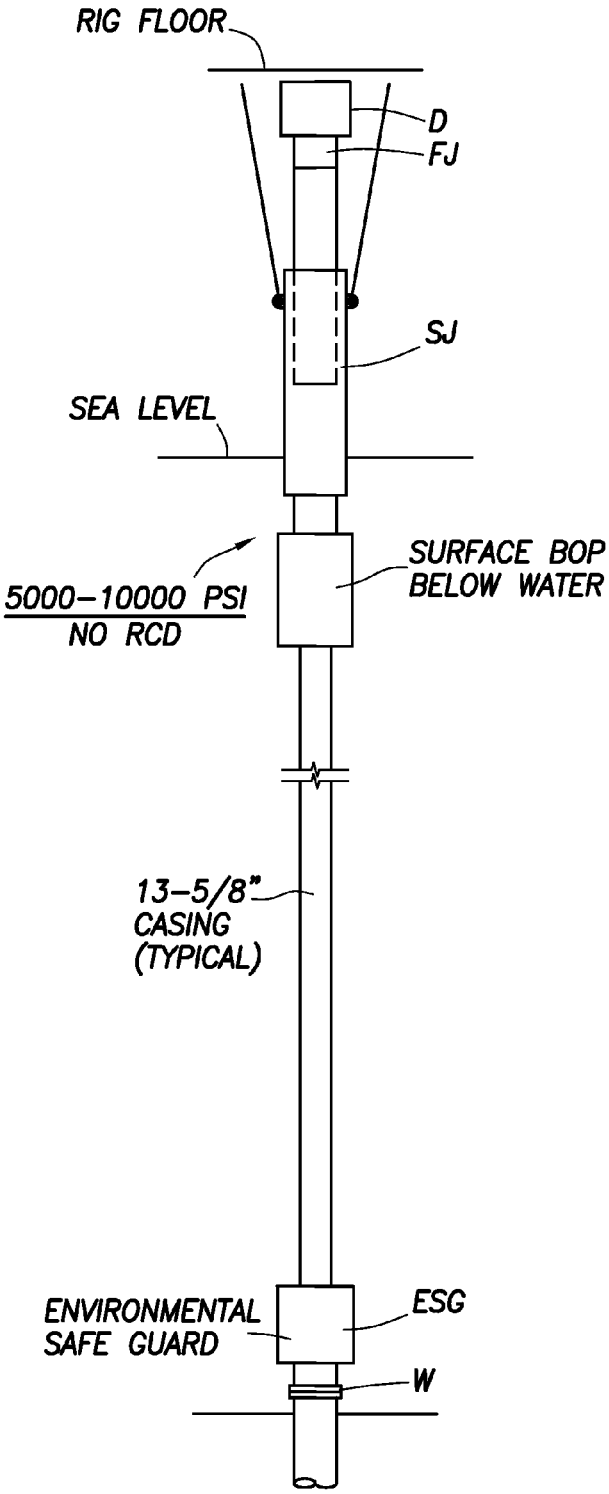
FIG. 3*c* is showing the drilling with a high pressure casing riser, a subsea quick disconnect system and a surface BOP in a different position that has been used for a few wells.
Figure 3D:
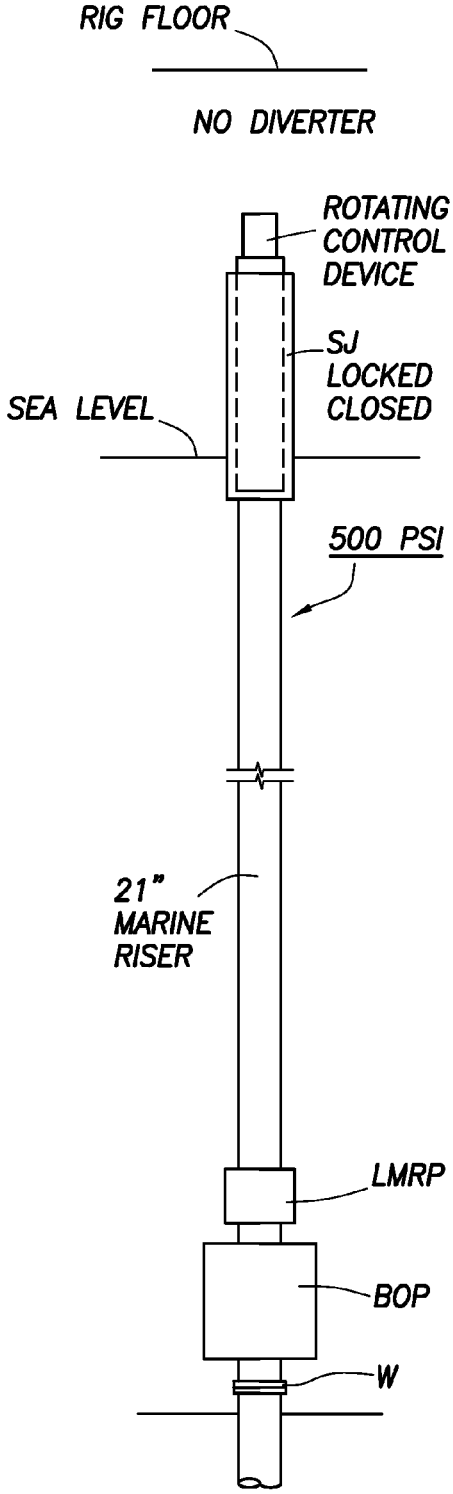
FIG. 3*d* shows the system depicted in FIG. 2, which has been used for about 20 wells in benign sea areas.
Figure 3E:
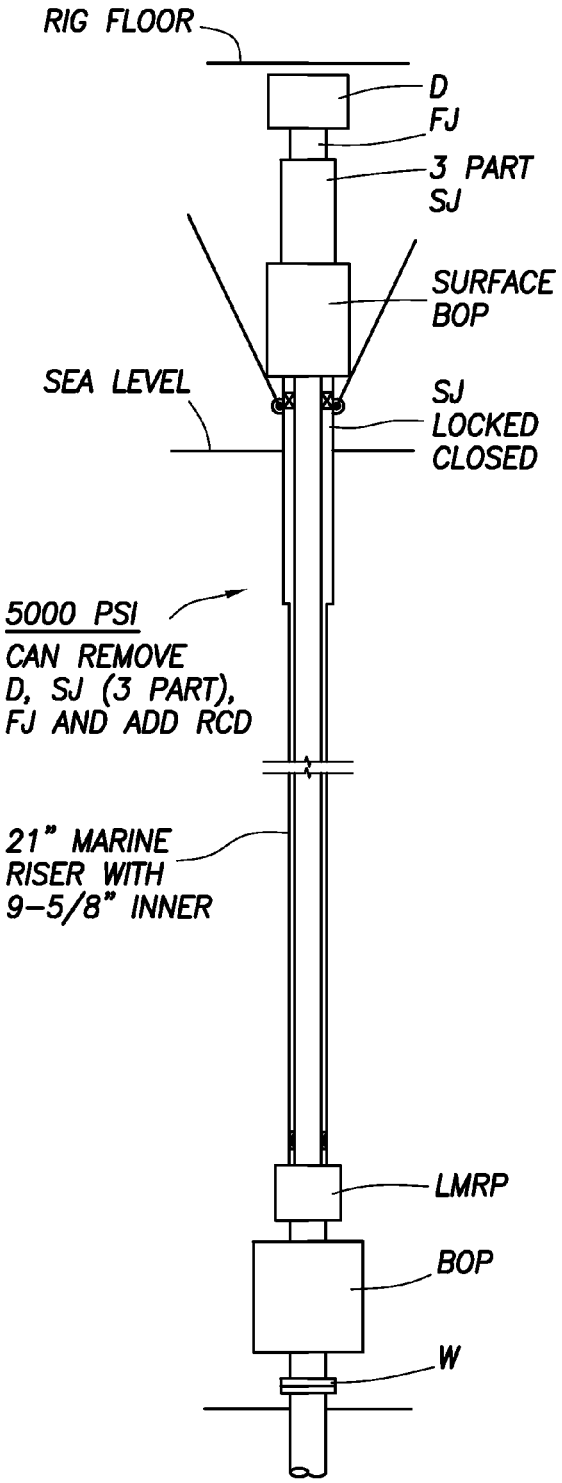
FIG. 3*e* shows a combination of system in FIG. 3*a* and system in FIG. 3*b* that has been proposed for wells but not yet used.

There is flexibility in the OURS system to be run in conjunction with conventional annular pressure control equipment, multiple RCDs, adapted to use with 13⅜ high pressure riser systems or other high pressure riser systems based in principle on the outlines in FIG. 3*b*, 3*c*, or 3*e*. Instead of the standard 21 inch riser system, any other size of riser system can also be adapted for use with the OURS and/or OURS-IS (discussed further below), which can be placed at any depth in the riser depending on requirements.

A refined and more sensitive control method for MPD (Managed Pressure Drilling) will be achieved by the OURS system with the introduction of Nitrogen in to the riser below the RCD. This will be for the purpose of smoothing out surges created by the heave of the floating drilling installation due to the cushioning effect of the Nitrogen in the riser as well as allowing more time for the choke manipulation to control the bottom hole pressure regime. It has been demonstrated on many MPD jobs carried out on non-floating drilling installations, that having a single phase fluid makes it more difficult to control the BHP with the choke manipulation. On a floating drilling installation any surge and swab through the RCD has a more direct effect on the BHP with the monophasic system as it is not possible to compensate with the choke system. With the OURS, the choke(s) can be controlled both manually and/or automatically with input from both surface and or bottom hole data acquisition.

The OURS System allows Nitrified fluid drilling that is still overbalanced to the formation, improved kick detection and control, and the ability to rotate pipe under pressure during well control events.

The OURS system allows a safer installation as there is no change in normal practice when running the riser system and all functions remain for subsea BOP control, emergency unlatch, fluid circulation, and well control.

The OURS includes seal bore protector sleeves and running tool(s) as required, enabling conversion from a standard riser section to full OURS system use.

The OURS also may include the addition of lines on the existing slip joint which can be done: (1) permanently with additional lines and gooseneck(s) on slip joint, and hollow pipes for feeding through hydraulic or electrical hoses; or (2) temporarily by strapping hoses and bundles to the slip joint if acceptable for environmental conditions.

Figure 8:
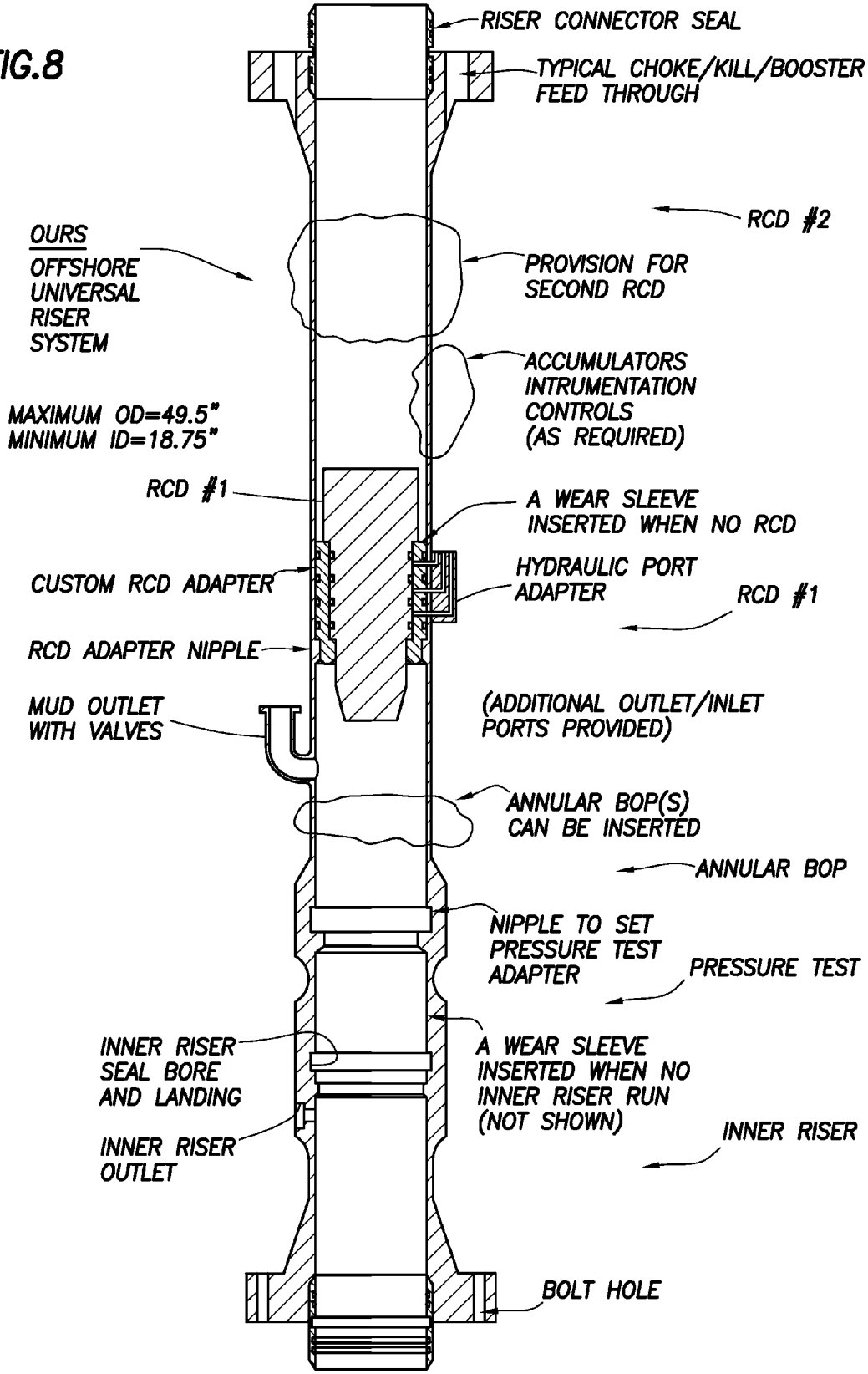
FIG. 8 is a schematic giving a detailed concept sketch for a 21 inch riser system.

The OURS makes the riser system more flexible by standardizing the ability to interface with any riser type and connection (e.g., Cameron 21 inch riser with RF connectors) and providing adapters that are preinstalled to take the RCD system being used. The adapters will also have wear sleeves to protect the sealing surfaces when the RCD is not installed. The principle is illustrated in FIG. 8 an embodiment of the OURS. Of course if a RCD design is custom made for installation into the particular riser type, it may be possible to insert it without an additional adapter. The principle being that it is possible to remove the whole RCD (Rotating Control Device) completely to provide the full bore requirement typical of that riser system and install a safety/wear sleeve to positively isolate any ports that are open and provide protection for the sealing surfaces when the RCD is not installed.

A system is disclosed for drilling deepwater in the floor of the ocean using rotatable tubulars. This consists of OURS (Offshore Universal Riser System) and OURS-IS (Offshore Universal Riser System-Injection System). The two components can be used together or independently.

The OURS-IS includes a riser section that is based on the riser system being used. Thus, e.g., in a 21 inch Marine Riser System it will have connectors to suit the particular connections for that system. Furthermore it will have all the usual lines attached to it that are required for a riser section below the slip joint SJ. In a normal 21 inch riser system this would be one choke line and one kill line as a minimum and others like booster line and/or hydraulic lines. For another type of riser, e.g., a 13⅝ casing based riser, it would typically have no other lines attached (other than those particularly required for the OURS).

The OURS acts as a passive riser section during normal drilling operations. When pressurized operations are required, components are inserted into it as required to enable its full functionality. The section of riser used for OURS may be manufactured from a thicker wall thickness of tube.

OURS

Figure 9:
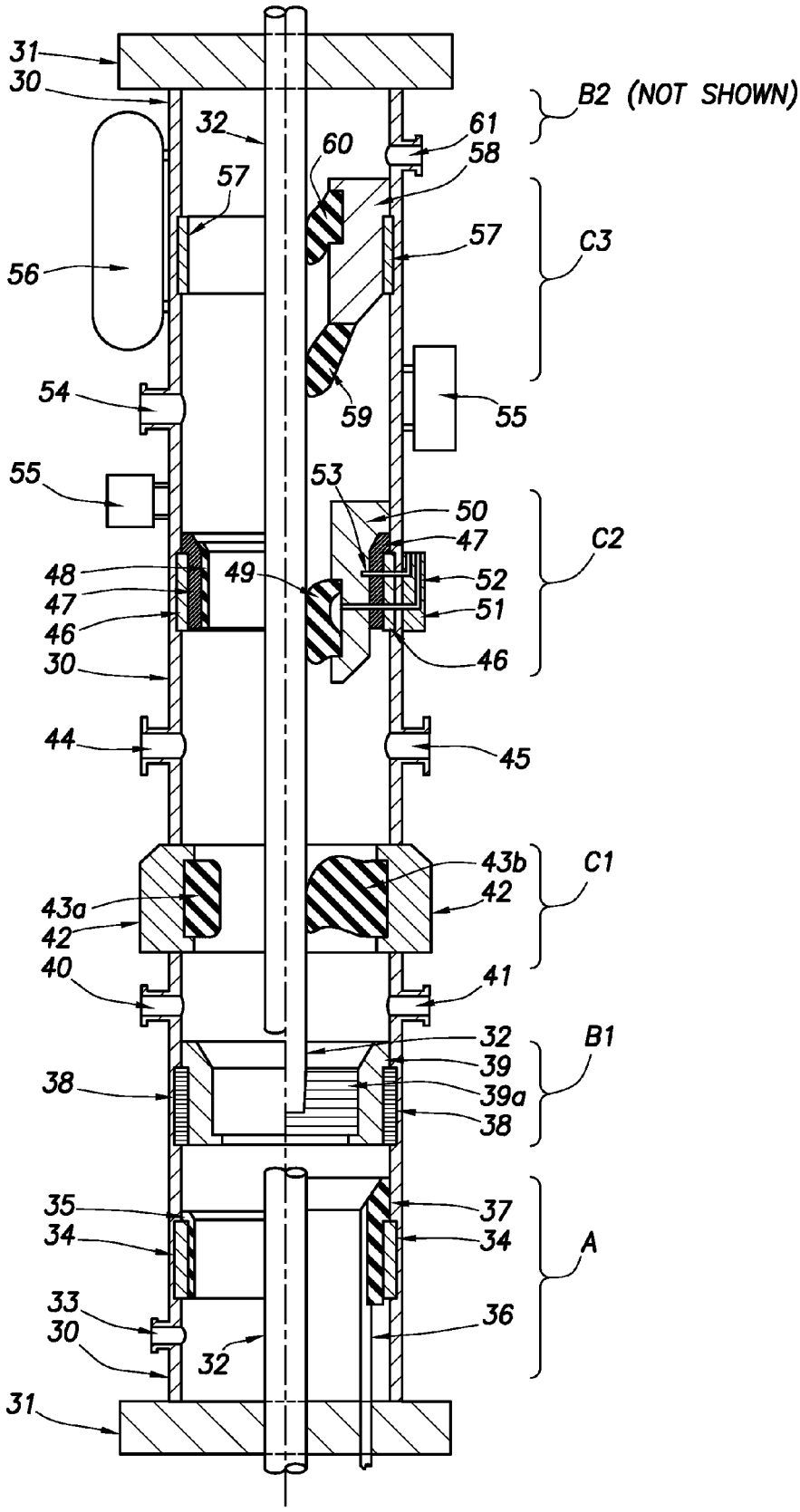
FIG. 9 is a cross section view giving a detailed cross-section of the system called OURS and is used to describe the invention.
Figure 10:
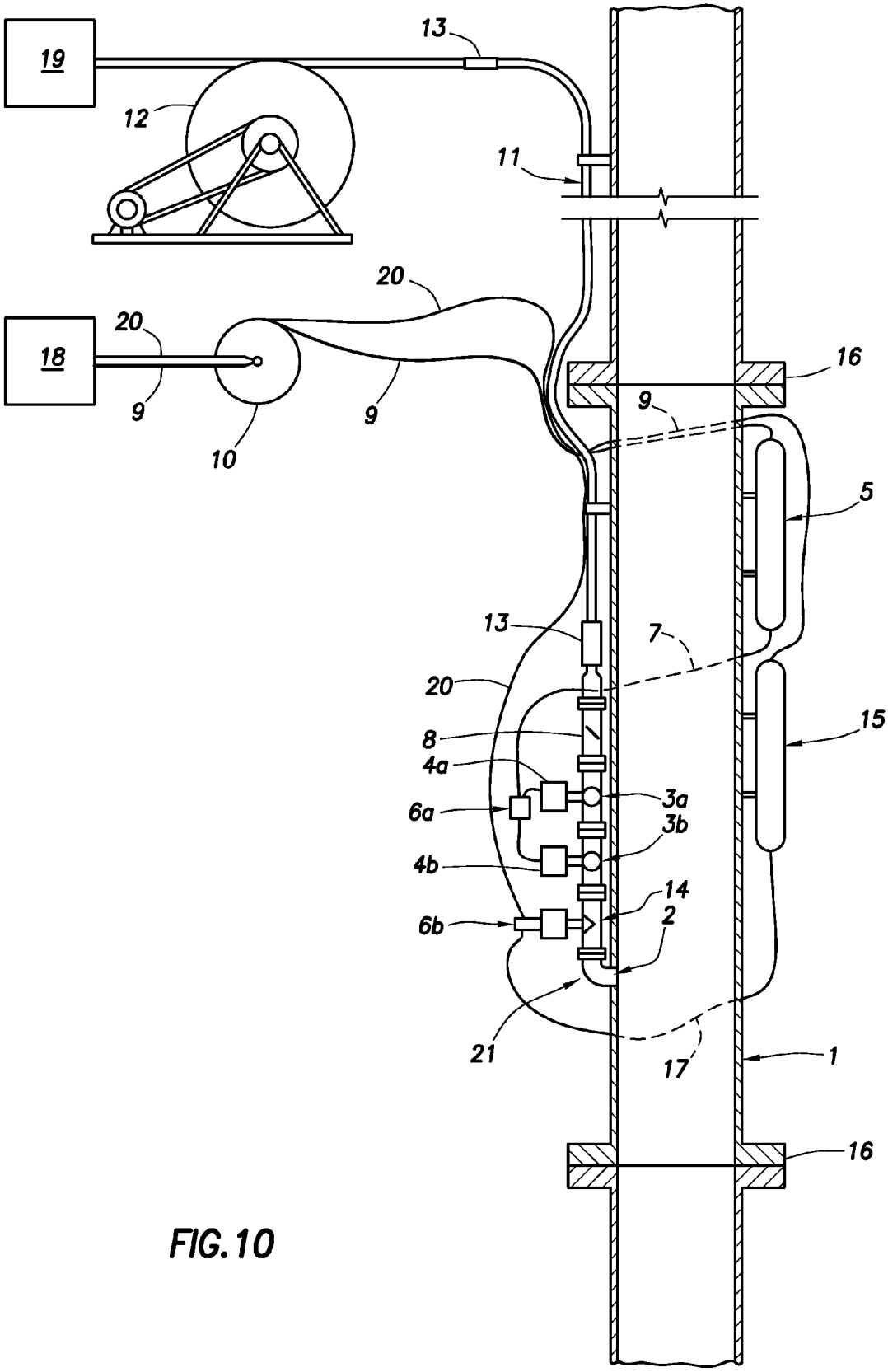
FIG. 10 is a schematic with partial cross section view giving a detailed cross-section of the Injection System of the present invention called OURS-IS which is used for description.

Referring to FIG. 9, this shows a detailed schematic cross section of an embodiment of an OURS. The drawing is split along the center line CL with the left hand side (lhs) showing typical configuration of internal components when in passive mode, and the right hand side (rhs) showing the typical configuration when in active mode. In the drawing, only major components are shown with details like seals, recesses, latching mechanisms, bearings not being illustrated. These details are the standard type found on typical wellbore installations and components that can be used with the OURS. Their exact detail depends on the particular manufacturers' equipment that is adapted for use in the OURS.

As illustrated in FIG. 9, the OURS includes a riser section 30 with end connectors 31 and a rotatable tubular 32 shown in typical position during the drilling process. This tubular 32 is shown for illustration and does not form part of the OURS. The section 30 may include a combination of components.

For example, the section 30 may include an adapter A for enabling an inner riser section to be attached to the OURS. This is for the purpose of raising the overall pressure rating of the riser system being used. For example, a 21 inch marine riser system may have a rating of 2000 psi working pressure. Installing a 9⅝ inch casing riser 36 will allow the riser internally to be rated to a new higher pressure rating dependent on the casing used. The OURS section will typically have a higher pressure rating to allow for this option.

The section 30 may also include adapters B1 and B2 for enabling pressure tests of the riser and pressure testing the components installed during installation, operation and trouble shooting.

The section 30 may also include adapters C1, C2, and C3, which allow insertion of BOP (Blow Out Preventer) components and RCD (Rotating Control Devices). A typical OURS will have at least one RCD device installed with a back-up system for safety. This could be a second RCD, an annular BOP, a Ram BOP, or another device enabling closure around the rotatable tubular 32. In the configuration shown in FIG. 9, a variety of devices are illustrated to show the principle of the OURS being universally adaptable. For example, but not intended to be limiting, C1 is a schematic depiction of an annular BOP shown as an integral part of the OURS. It is also possible to have an annular BOP as a device for insertion. C2 shows schematically an active (requires external input to seal) RCD adaptation and C3 shows a typical passive (mechanically sealing all the time) RCD adaptation with dual seals.

Figure 11:
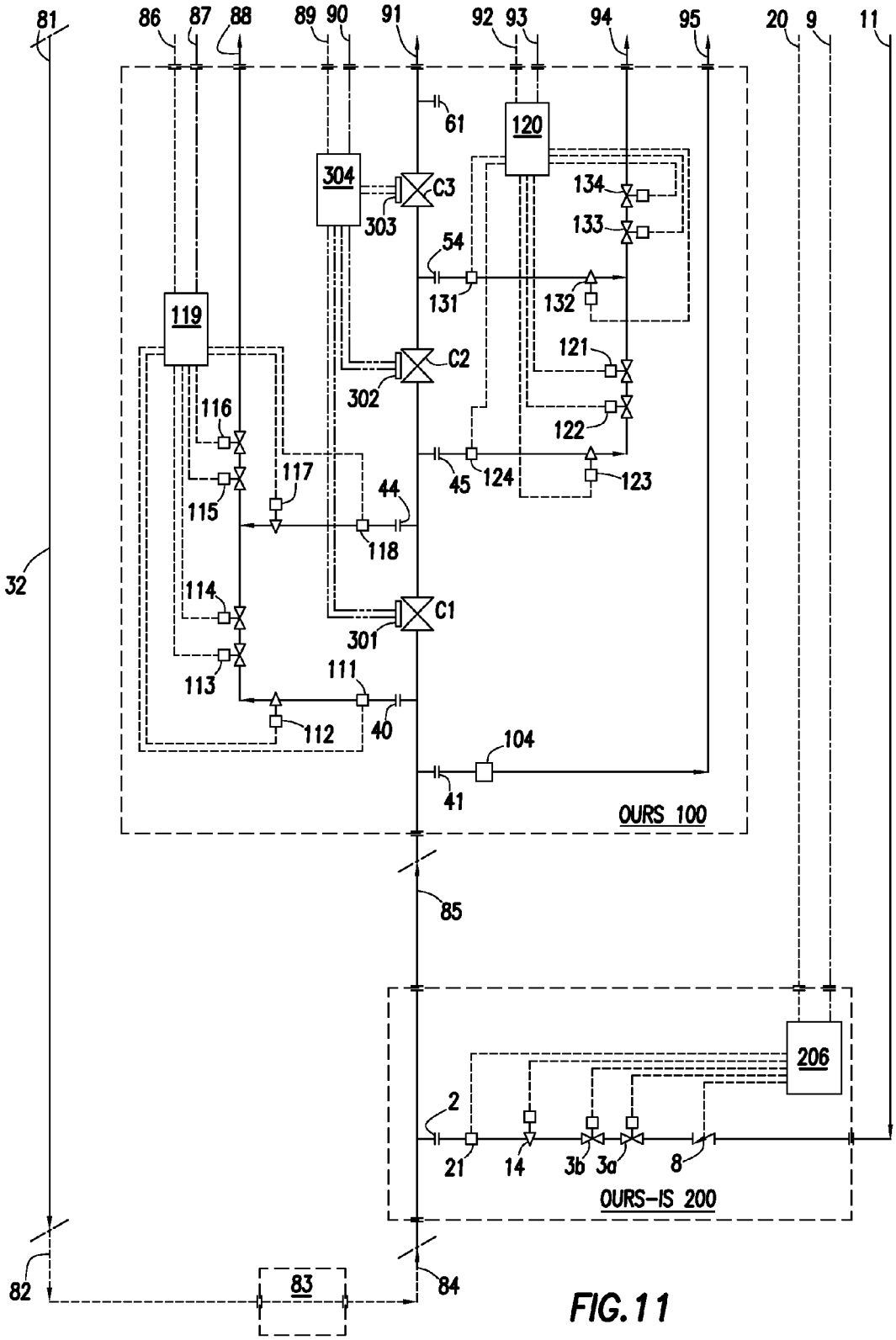
FIG. 11 is a Process and Instrumentation Diagram (P&ID) used to describe the OURS and OURS-IS.

The OURS has several outlets to enable full use of the functionality of the devices A, B, and C1-C3. These include outlet 33 which allows communication to the annulus between the inner and outer riser (if installed), inlet/outlet 40 which allows communication into the riser below the safety device installed in C1, outlet 41 which is available for use as an emergency vent line if such a system is required for a particular use of the OURS, outlet/inlet 44 which would be the main flow outlet (can also be used as an inlet for equalization), outlet 45 which can be used to provide a redundant flow outlet/inlet, outlet 54 which can be used as an alternative outlet/inlet and outlet 61 which can be used as an inlet/outlet. The particular configuration and use of these inlets and outlets depends on the application. For example, in managed pressure drilling, outlets 44 and 45 could be used to give two redundant outlets. In the case of mud-cap drilling, outlet 44 would be used as an inlet tied into one pumping system and outlet 45 would be used as a back-up inlet for a second pumping system. A typical hook-up schematic is illustrated in FIG. 11. which will be described later.

The details for the devices are now given to allow a fuller understanding of the typical functionality of the OURS. The OURS is designed to allow insertion of items as required, i.e., the clearances allow access to the lowermost adapter to insert items as required, with increases in clearance from bottom to top.

Device A is the inner riser adapter and may be specified according to the provider of the inner riser system. On the lhs (left hand side) item 34 is the adapter that would be part of the OURS. This would have typically a sealbore and a latch recess. A protector sleeve 35 would usually be in place to preserve the seal area. On the rhs (right hand side) the inner riser is shown installed. When the inner riser 36 is run, this sleeve 35 would be removed to allow latching of the inner riser 36 in the adapter 34 with the latch and seal mechanism 37. The exact detail and operation depends on the supplier of the inner riser assembly. Once installed, the inner riser provides a sealed conduit eliminating the pressure weakness of the outer riser 30. The OURS may be manufactured to a higher pressure rating so that it could enable the full or partial pressure capability of the inner riser system. An outlet 33 is provided to allow monitoring of the annulus between inner riser 36 and outer riser 30.

Devices B1 and B2 are pressure test adapters. Normally in conventional operations the riser is never pressure tested. All pressure tests take place in the subsea BOP stack. For pressurized operations, a pressure test is required of the full riser system after installation to ensure integrity. For this pressure, test adapter B2 is required which is the same in principle as the description here for pressure test adapter B1. The OURS includes an adapter 38 for the purpose of accepting a pressure test adapter 39. This pressure test adapter 39 allows passage of the maximum clearance required during the pressurized operations. It can be pre-installed or installed before pressurized operations are required. When a pressure test is required, an adapter 39*a* is attached to a tubular 32 and set in the adapter 39 as illustrated in the rhs of FIG. 9. The adapter 39*a* will lock positively to accept pressure tests from above and below. The same description is applicable for device B2, which is installed at the very top of the OURS, i.e., above the outlet 61. With B2, the whole riser and OURS can be pressure tested to a 'test' pressure above subsequent planned pressure test. Once the overall pressure test is achieved with device B2, subsequent pressure tests will usually use device B1 for re-pressure testing the integrity of the system after maintenance on RCDs.

Device C1 is a safety device that can be closed around the rotatable tubular 32, for example but not being limited to an annular BOP 42, a ram BOP adapted for passage through the rotary table, or an active RCD device like that depicted in C2. The device C1 can be installed internally like C2 and C3 or it can be an integral part of the OURS as depicted in FIG. 9. Item 42 is a schematic representation of an annular BOP without all the details. When not in use as shown on the lhs, the rubber element is in a relaxed state 43*a*. When required, it can be activated and will seal around the tubular 32 as shown on the rhs with representation 43*b*. For particular applications, e.g., underbalanced flow drilling where hydrocarbons are introduced into the riser under pressure, two devices of type C1 may be installed to provide a dual barrier.

Device C2 schematically depicts an active RCD. An adapter 46 is part of the OURS to allow installation of an adapter 47 with the required seal and latch systems that are designed for the particular RCD being used in the OURS. Both adapters 46 and 47 have ports to allow the typical supply of hydraulic fluids required for the operation of an active RCD. A seal protector and hydraulic port isolation sleeve 48 are normally in place when the active RCD 50 is not installed as shown on the lhs. When the use of the active RCD 50 is required, the seal protector sleeve 48 is pulled out with a running tool attached to the rotatable tubular. Then the active RCD 50 is installed as shown on the rhs. A hydraulic adapter block 51 provides communication from the hydraulic supply (not shown) to the RCD. Schematically two hydraulic conduits are shown on the rhs. The conduit 52 supplies hydraulic fluid to energize the active element 49 and the hydraulic conduit 53, which typically supplies oil (or other lubricating fluid) to the bearing. A third conduit may be present (not shown) which allows recirculation of the bearing fluid. Depending on the particular type of active RCD, more or fewer hydraulic conduits may be required for other functions, e.g., pressure indication and/or latching functions.

Device C3 schematically depicts a passive RCD 58 with two passive elements 59 and 60 as is commonly used. An adapter 57 is installed in the OURS. It is possible to make adapters that protect the sealing surface by bore variations and in such a case for a passive head requiring no utilities (some require utilities for bearing lubrication/cooling) no seal protector sleeve is required. In this case the passive RCD 58 can be installed directly into the adapter 57 as shown on rhs with the sealing elements 59 and 60 continuously in contact with the tubular 32. This schematic installation also assumes that the latching mechanism for the RCD 58 is part of the RCD and activated/deactivated by the running tool(s).

The OURS may also include other items attached to it to make it a complete package that requires no further installation activity once installed in the riser. These other items may include instrumentation and valves attached to the outlets/inlets 33, 40, 41, 44, 45, 54, 61. These are described in FIG. 11. To enable full functionality of these outlet utilities and of the devices installed (A, B1, B2, C1, C2, C3) the OURS includes a control box 55 that centralizes all the monitoring activities on the OURS and provides a data link back to the floating drilling installation. The OURS includes a control box 55 that provides for control of hydraulic functions of the various devices and an accumulator package 56 that provides the reserve pressure for all the hydraulic utilities. Other control/utility/supply boxes may be added as necessary to minimize the number of connections required back to surface.

Referring to FIG. 11, this shows the typical flow path through the OURS 100 and OURS-IS 200. Drilling fluid 81 flows down the rotatable tubular 32, exiting at the drilling bit 82. Then the fluid is a mixture of drilling fluid and cuttings that is returning in the annulus between the rotatable tubular and the drilled hole. The flow passes through a subsea BOP 83 if installed and then progresses into the riser 84. The OURS-IS 200 can inject variable density fluid into this return flow. The flow 85 continues as a mixture of drilling fluid, cuttings, and variable density fluid introduced by the OURS-IS up the riser into the OURS 100. There it passes through the safety devices C1, C2, and C3 and proceeds into the slip joint 91.

Outlet 41 is connected to a safety device 104 that allows for pressure relief back to the floating drilling installation through line 95. This safety device may be a safety relief valve or other suitable system for relieving pressure.

Devices C1, C2, and C3 are connected through their individual control pods 301, 302, and 303 respectively to a central electro-hydraulic package 304 that also includes accumulators. It has an electric line 89 and a hydraulic line 90 back to the floating drilling installation. In concept, the usage of the different connections is similar so the following description for items 40, 111, 112, 113, 114, and 119 is the same as for: 44, 118, 117, 115, 116, and 119; and for: 45, 124, 123, 122, 121, and 120; as well as for 54, 131, 132, 133, 134, and 120.

How many of these sets of connections and valves are installed is dependent on the planned operation, number of devices (C1, C2, and C3) installed, and the degree of flexibility required. A similar set of items can be connected to outlet 61 if required.

Taking outlet/inlet 40 as a typical example of the above listed sets, an instrument adapter 111 which can measure any required data, typically pressure and temperature, is attached to the line from outlet 40. The flow then goes through this line through a choking system 112 that is hydraulically or otherwise controlled, then through two hydraulically controlled valves 113 and 114 of which at least one is fail closed. The flow can then continue up line 88 back to the floating drilling installation. Flow can also be initiated in reverse down this line if required. As depicted, FIG. 11 is a typical Process and Instrumentation diagram and can be interpreted as such, meaning any variation of flow patterns as required can be obtained by opening and closing of valves in accordance with the required operation of the devices C1, C2, and C3 which can be closed or opened (except, for example, the passive RCD 58 depicted in FIG. 9, which is normally always closed).

Variable density fluid is injected down conduit 11 to the OURS-IS 200 and the detailed description for this is below.

OURS-IS

The OURS-IS consists of a riser section (usually a shorter section called a pup) which has an inlet, and a composite hose system, or other suitable delivery mechanism to allow injection of different density fluids into the riser at any point between the subsea BOP and the top of the OURS.

The OURS-IS can be used independently of or in conjunction with the OURS on any floating drilling installation to enable density variations in the riser.

The OURS-IS allows the injection into the riser of Nitrogen or Aphrons (glass spheres), or fluids of various densities which will allow hydrostatic variations to be applied to the well, when used in conjunction with a surface or sub surface choke. As described previously, the OURS-IS is a conduit through which a Nitrogen cushion could be applied and maintained to allow more control of the BHP by manipulation of the surface choke, density of fluid injected, and injection rate both down the drill string and into the annulus through the OURS-IS.

The OURS-IS externally includes all the usual riser connections and attachments required for a riser section. Additionally, the OURS-IS includes provision for mounting an accumulator(s) (shown), provision for accepting instrumentation for measuring pressure, temperature, and any other inputs or outputs. Emergency Shut Down system(s) and remote operated valve(s), a hydraulic bundle line supplying hydraulic fluid, hydraulic pressure and control signals to the valve, and choke systems may also be included on the OURS-IS.

The OUR-IS may be solely a hydraulic system, a hydraulic and electric bundle line for instrumentation or other electrical control requirements, or a full MUX (Multiplex) system. A choking system may also be inserted in the fluid injection line (shown) that is remotely and automatically controlled.

A riser section 1, which may be a riser pup, of the same design as the riser system with the same connections 16 as the riser system is the basis of the OURS-IS. This riser section 1 includes a fluid injection connection with communication to the inside of the riser 2. This connection 2 can be isolated from the riser internal fluid by hydraulically actuated valves 3*a* and 3*b* fitted with hydraulic actuators 4*a* and 4*b*. The injection rate can be controlled both by a surface system 15 (pump rate and/or choke) and sub-sea by a remotely operated choke 14. As added redundancy, one or more nonreturn valve (s) 8 may be included in the design. The conduit to supply the injection fluid from surface to the OURS-IS is shown as a spoolable composite pipe 11, which can be easily clamped 16 to the riser or subsea BOP guidelines (if water depth allows and they are in place). Composite pipe and spooling systems as supplied by the Fiberspar Corporation are suitable for this application. The composite pipe 11 is supplied on a spoolable reel 12. The composite pipe 11 can be easily cut and connectors 13 fitted insitu the floating drilling installation for the required length. The operating hydraulic fluid for the actuators 4*a* and 4*b* of subsea control valves 3*a* and 3*b* and hydraulic choke 14 can be stored on the OURS-IS in accumulators 5 and 15, respectively. They can be individual, independent accumulator systems or one common supply system with electronic control valves as supplied in a MUX system. The fluid to the accumulators 5 and 15 is supplied and maintained through hydraulic supply line 9 from hydraulic hose reel 10 supplied with hydraulic fluid from the hydraulic supply & control system 18. Hydraulic fluid for the valve actuators 4*a* and 4*b* from the accumulator 5 is supplied through hose 7 and hydraulic fluid from accumulator 15 is supplied through hose 17 to hydraulic choke 14. Electro-hydraulic control valve 6*a* for actuators 4*a* and 4*b* allows closing and opening of valves 3*a* and 3*b* by way of electrical signals from surface supplied by electric line 20 and electro-hydraulic control valve 6*b* allows closing and opening of the hydraulic choke 14 similarly supplied by control signal from surface by line 20.

During conventional drilling operations, the valves 3*a* and 3*b* are closed and the OURS-IS acts like a standard section of riser. When variable density operations are required in the riser, valves 3*a* and 3*b* are opened by hydraulic control and fluid, e.g., Nitrogen is injected by the surface system 19 through the hose reel 12 down the hose 11 into the riser inlet 2. The rate can be controlled at the surface system 19 or by the downhole choke 14 as required. One of the hydraulic control valves 3*b* is set-up as a fail-safe valve, meaning that if pressure is lost in the hydraulic supply line it will close, thus always ensuring the integrity of the riser system. Similarly, when a return to conventional operations is required, fluid injection is stopped and the valves 3*a* and 3*b* are closed.

The OURS-IS may include, as illustrated in FIG. 11, pressure and temperature sensors 21, plus the required connections and systems going to a central control box 206 to transmit these to surface. The valves 3*a*, 3*b*, and choke 14 may be operated by electric signal and lines (9 and 20) run with the hydraulic hose reel or by acoustic signal or other system enabling remote control from surface.

In FIG. 11 the variable density fluid is injected down the conduit 11, through a non-return valve 8, two hydraulic remote controlled valves 3*a* and 3*b*, then through a remote controlled choke 14 into inlet 2. An instrument adapter 21 allows the measurement of desired data which is then routed to the control system 206 which consists of accumulators, controls which receives input/output signals from line 20 and hydraulic fluid from line 9.

Use and Operation

An example use and operating method is described here for a typical floating drilling installation to illustrate an example method of use of the system.

The Offshore Universal Riser System (OURS) will be run as a normal section of riser through the rotary table, thus not exceeding the normal maximum OD for a 21 inch riser system of about 49 inches or 60 inches as found on newer generation floating drilling installations. It will have full bore capability for 18¾ inch BOP stack systems and be designed to the same specification mechanically and pressure capability as the heaviest wall section riser in use for that system. An Offshore Universal Riser System-Injection System (OURS-IS) will be run in the lower part of the riser with spoolable composite pipe (FIBERSPAR a commercially available composite pipe is suitable for this application).

In normal drilling operations with, e.g., a plan to proceed to Managed Pressure Drilling, the OURS and OURS-IS will be run with all of the externals installed. The OURS and OURS-IS will be installed with seal bore protector sleeves in place and pressure tested before insertion into riser. During conventional drilling operation the inlet and outlet valves will be closed and both the OURS and OURS-IS will act as normal riser pup joints. The OURS will be prepared with the correct seal bore adapters for the RCD system to be used.

When pressurized operations are required, the OURS-IS is prepared and run as part of the riser inserted at the point required. The necessary connections for lines 9 and 20 are run, as well as the flexible conduit 11, for injecting fluids of variable density. The cables and lines are attached to the riser or to the BOP guidelines if present. Valves 3*a* and 3*b* are closed.

The OURS is prepared with the necessary valves and controls as shown in FIG. 11. All the valves are closed. The hoses and lines are connected as necessary and brought back to the floating drilling installation.

Pipe will be run in hole with a BOP test adapter. The test adapter is set in the subsea wellhead and the annular BOP C3 is closed in the OURS. A pressure test is then performed to riser working pressure. The annular C3 in the OURS is then opened and the pressure test string is pulled out. If the subsea BOP has rams that can hold pressure from above, a simpler test string can be run setting a test plug in adapter B2 on the OURS. (FIG. 9)

When the OURS is required for use, an adapter 39 will be run in the lower nipple B1 of the OURS to provide a pressure test nipple similar to that of the smallest casing string in the wellhead so that subsequent pressure tests do not require a trip to subsea BOP.

The seal bore protector sleeve 48 for the RCD adapter C2 may be pulled out. Then the RCD 50 can be set in C2. Once set, the RCD 50 is function tested.

The rotatable tubular 32 is then run in hole with the pressure test adapter 39*a* for OURS until the adapter 39*a* is set in adapter 39. The RCD 50 is then closed and, for active systems only, fluid is circulated through the OURS using, e.g., outlet 44. The outlet 44 is then closed and the riser is pressure tested. Once pressure tested, the pressure is bled off and the seal element on the RCD is released. The test assembly is then pulled out of the OURS. A similar method may be completed to set another RCD in section C3.

The drilling assembly is then run in hole and circulation at the drilling depth is established. The pumps are then stopped. Once stopped, the RCD 50 seal element is installed (only if needed for the particular type of RCD), and the RCD 50 is activated (for active systems only). The mud outlet 44 on the OURS is then opened. Circulation is then established and backpressure is set with an automated surface choke system or, alternatively, the choke 117 connected to the outlet 44. If a change in density is required in the riser fluid, choke 14 is closed on the OURS-IS and valves 3*a*, 3*b* are opened. A fluid, such as but not limited by, Nitrogen is circulated at the desired rate into return flow to establish a cushion for dampening pressure spikes. It should be appreciated that Nitrogen is only an example, and that other suitable fluids may be used. For example, a flow stream containing compressible agents (e.g., solids or fluids whose volume varies significantly with pressure) may be injected into the riser at an optimum point in order to provide this damping. Drilling is then resumed.

Figure 3F:
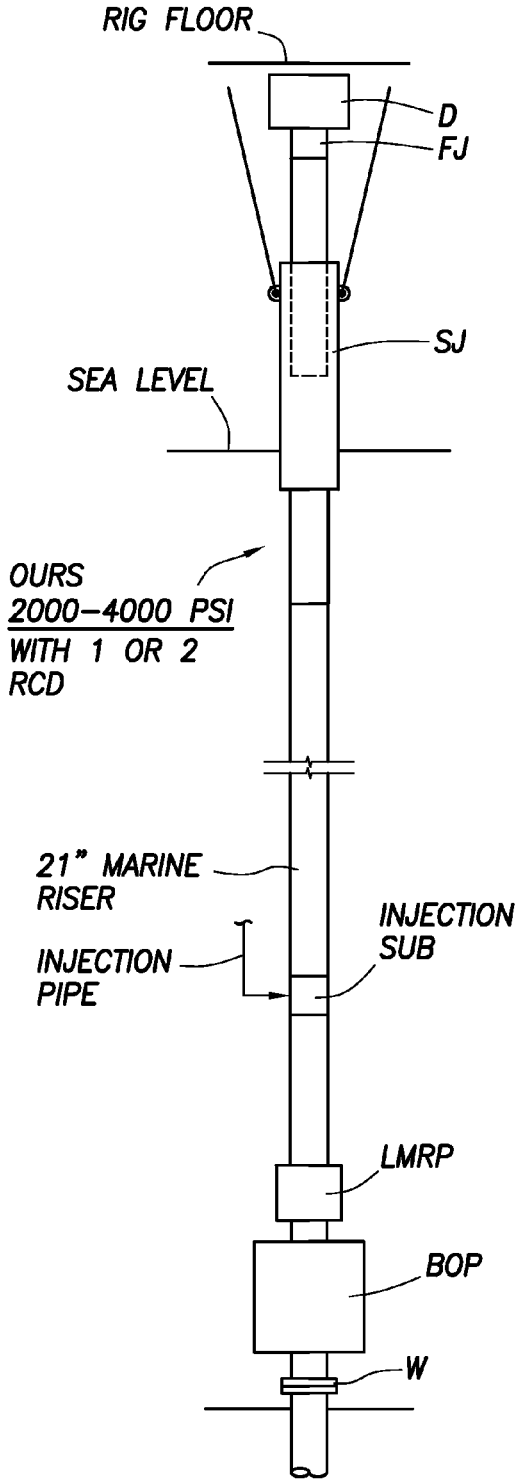
FIG. 3*f* shows the system of the current invention as applied to the most common system in use today as shown in FIG. 3*a;*
Figure 3G:
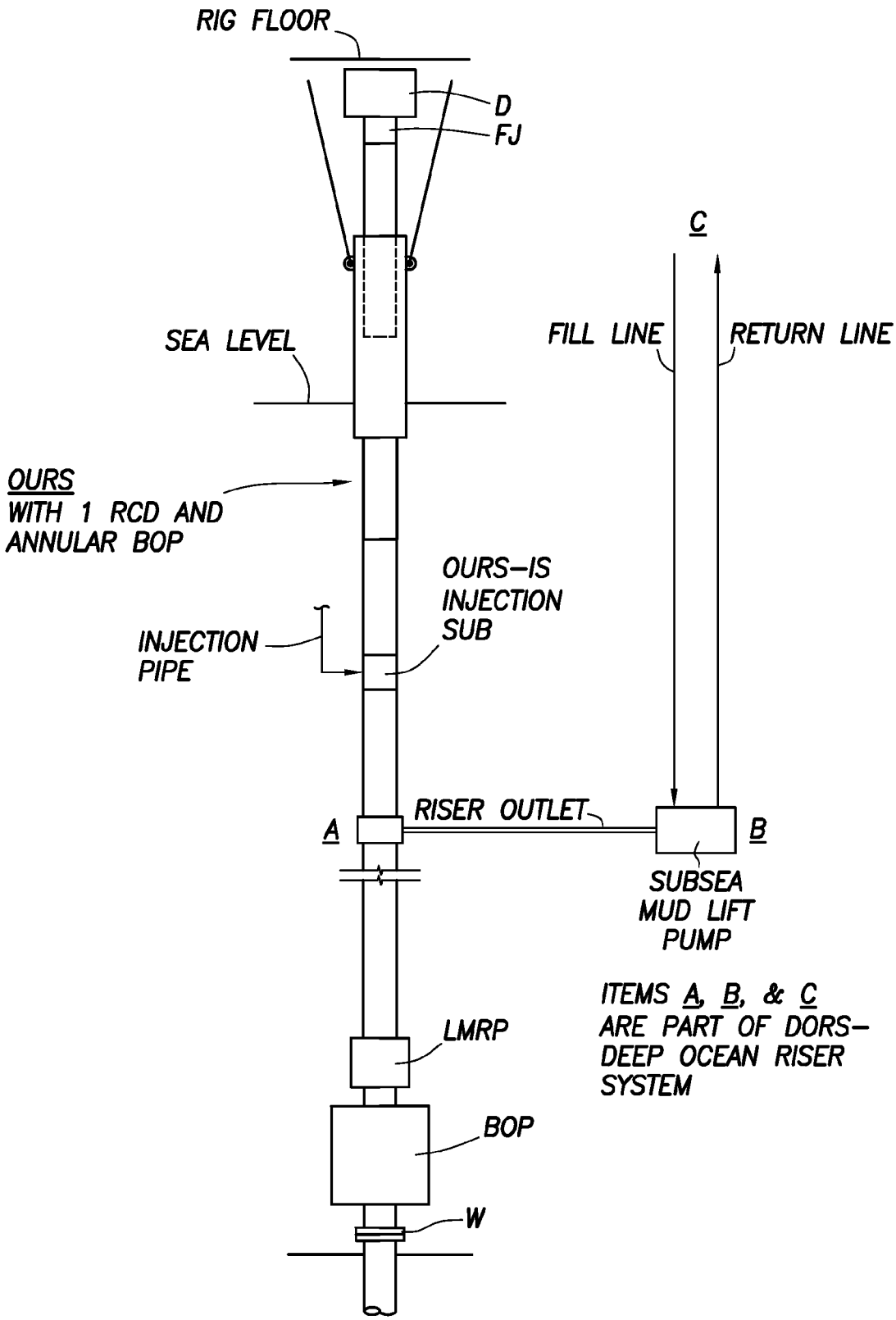
FIG. 3*g* shows the system used to enable the DORS (Deep Ocean Riser System)
Figure 4:
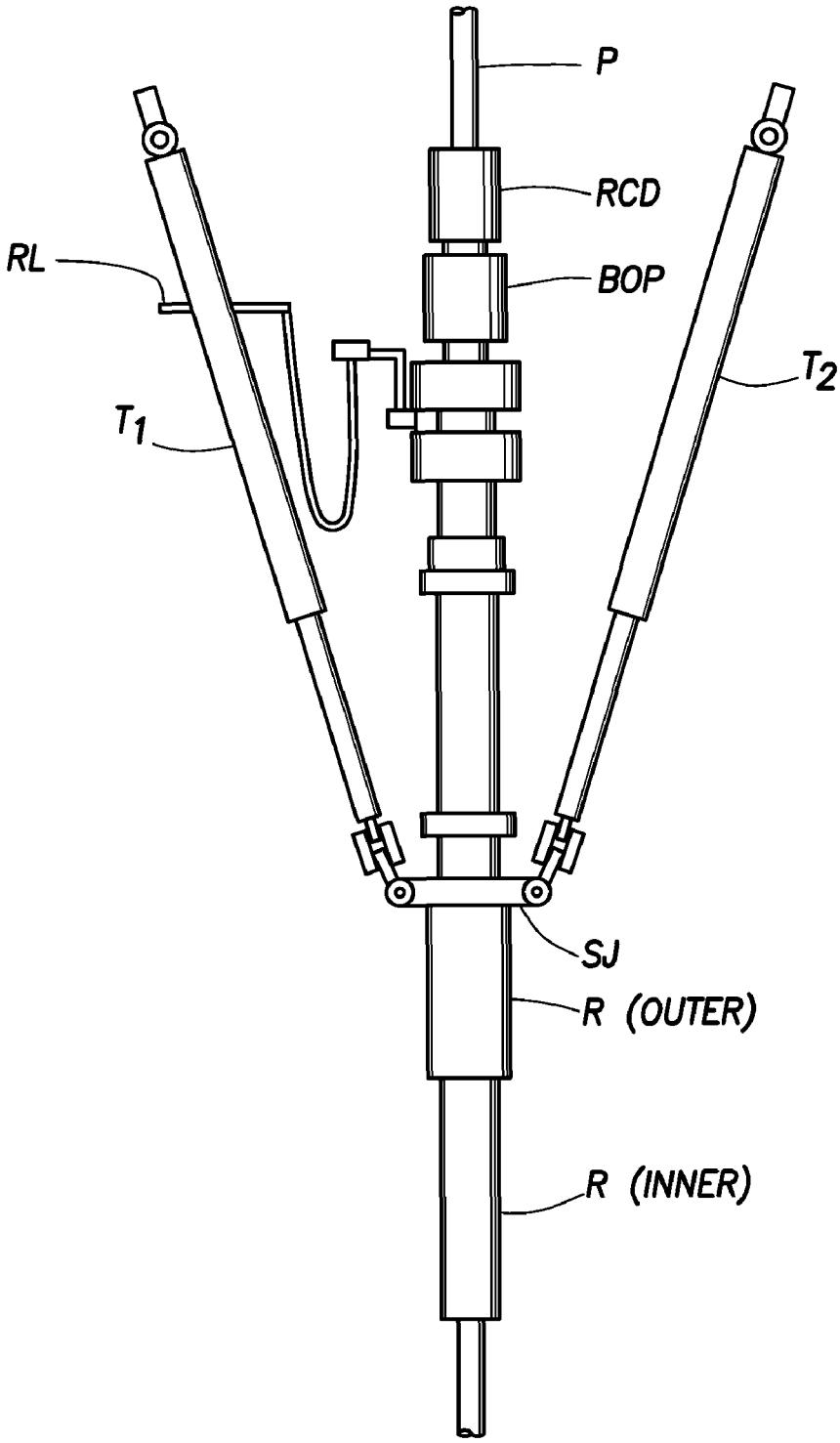
FIG. 4 (PRIOR ART)
FIG. 4 is an elevation view of prior art giving the detail of the prior art system used in FIG. 3*b*, i.e., the use of a surface BOP.
Figure 5:
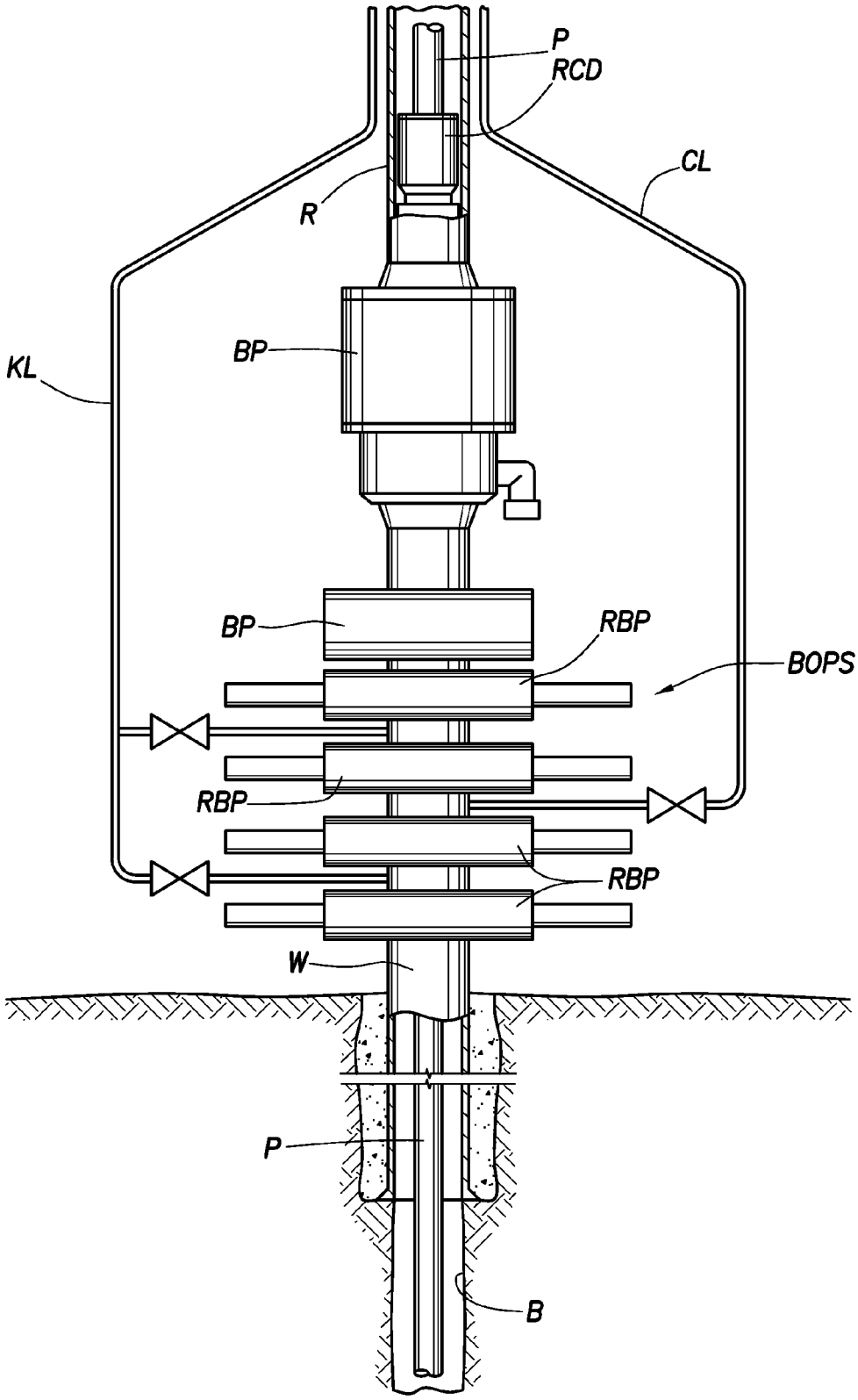
FIG.5 (PRIOR ART)
FIG. 5 is an elevation view of prior art showing a rotating control device attached to the top of the subsea BOP stack.
Figure 6A:
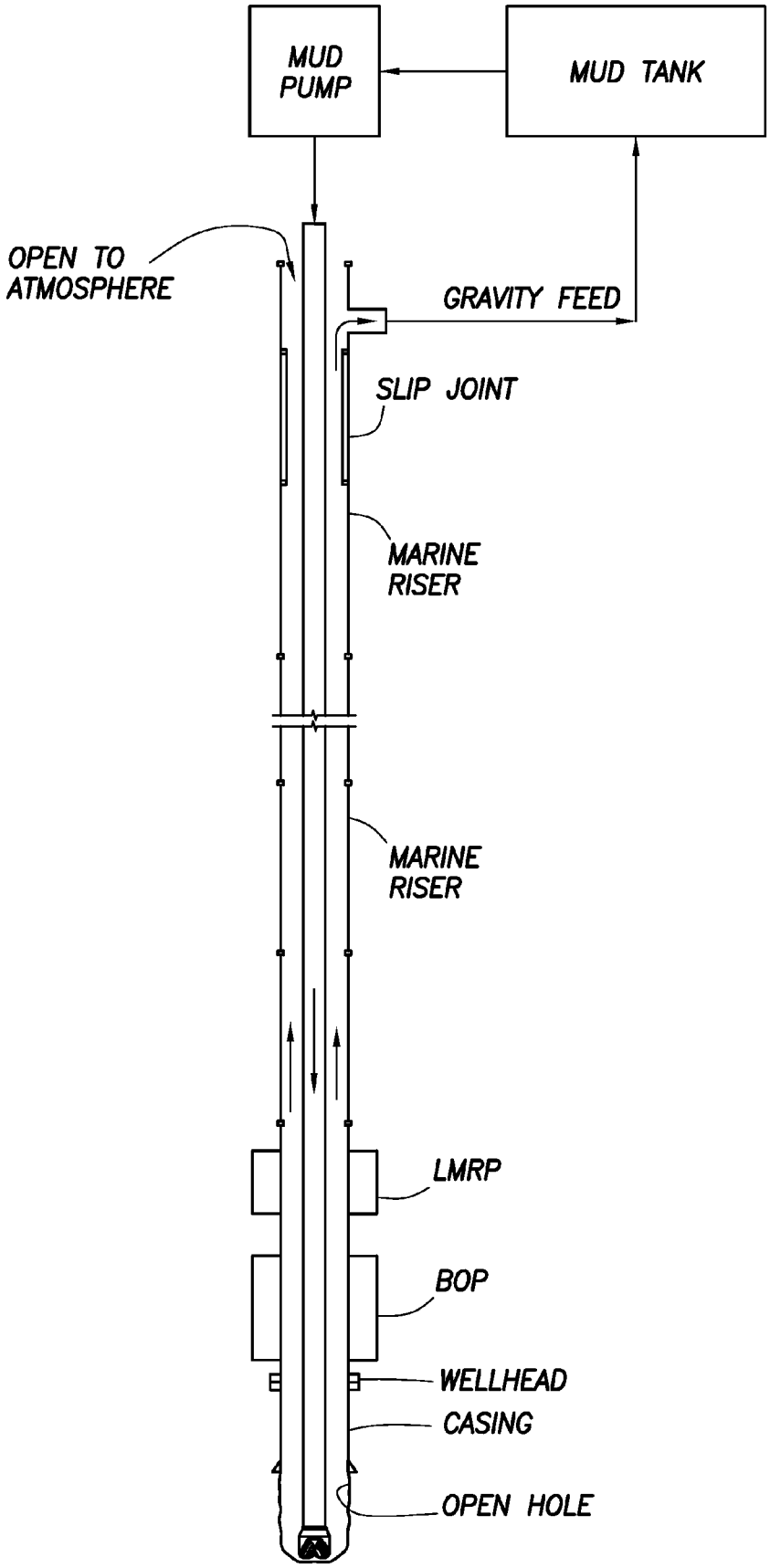
FIG. 6*a* is a schematic showing the concept of conventional drilling.
Figure 6B:
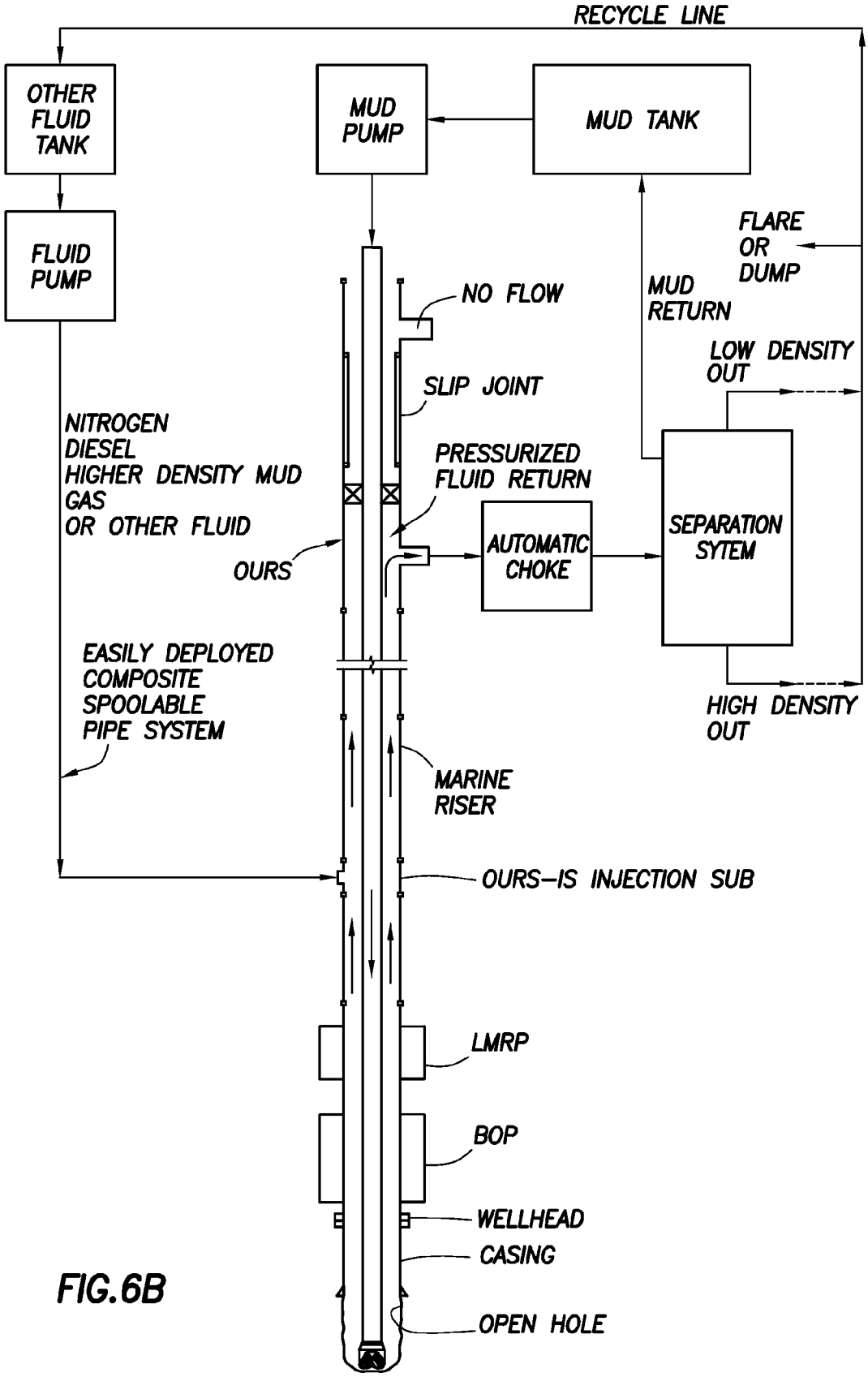
FIG. 6*b* is a schematic showing the concept of closed system drilling.
Figure 7:
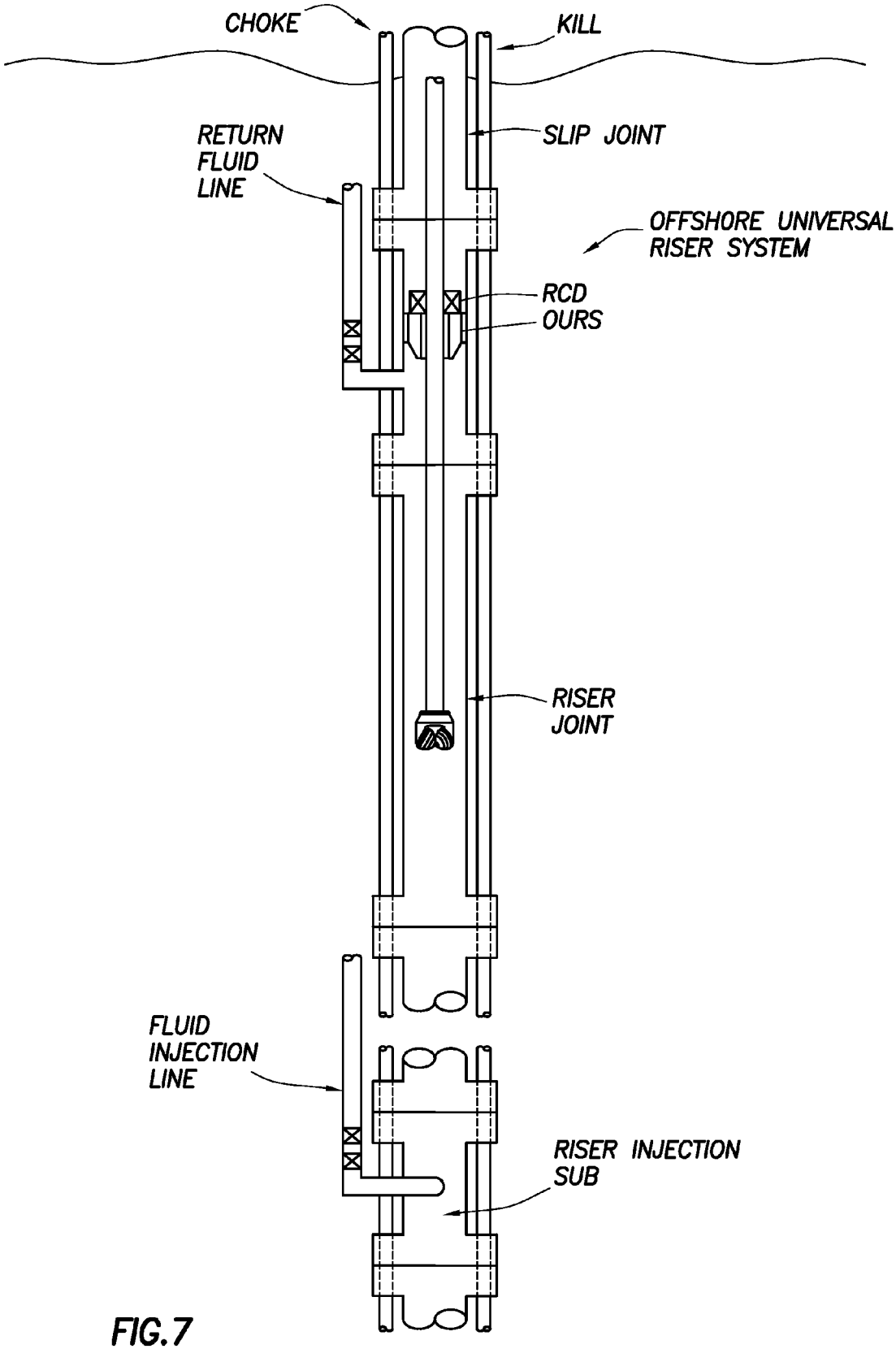
FIG. 7 is a schematic giving a concept of the present invention.

The system is shown in FIG. 3*f* and depicted schematically in FIG. 6*b*. A typical preferred embodiment for the drilling operation using this invention would be the introduction of Nitrogen under pressure into the return drilling flow stream coming up the riser. This is achieved by the presently described invention by the OURS-IS (Injection System) with an attached pipe that can be easily run as part of any of the systems depicted in FIGS. 3*a* to 3*g*.

Variations of the above method with the OURS and OURS-IS will enable a variety of drilling permutations that require pressurized riser operations, such as but not limited by Dual density or Dual Gradient drilling; Managed Pressure Drilling (both under and overbalanced mud weights); Underbalanced drilling with flow from the formation into the wellbore; Mud-cap drilling—i.e., Injection drilling with no or little return of fluids; and Constant bottom hole pressure drilling using systems that allow continuous circulation. The OURS/OURS-IS enables the use of DAPC (Dynamic Annular Pressure Control) and SECURE (Mass balance drilling) systems and techniques. The OURS/OURS-IS also enables the use of pressurized riser systems with surface BOP systems run below the water line. The OURS/OURS-IS can also be used to enable the DORS (Deep Ocean Riser System). The ability to introduce Nitrogen as a dampening fluid will for the first time give a mechanism for removing or very much reducing the pressure spikes (surge and swab) caused by heave on floating drilling installations. The OURS/OURS-IS enables a line into any of the systems depicted in FIGS. 3*a* to 3*g* and allows the placement of this line at any point between the surface and bottom of the riser. The OURS and OURS-IS can be used without a SBOP, thus substantially reducing costs and enabling the technology shown in FIG. 3*g*. This FIG. 3*g* also illustrates moving the OURS-IS to a higher point in the riser.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. An offshore riser system, comprising:

a riser string interconnecting a drilling rig to a subsea wellhead, the riser string comprising a section of riser tubing including a first seal bore therein which sealingly receives a rotating control device therein, the rotating control device including a latching mechanism which secures the rotating control device in the first seal bore, the rotating control device sealing off an annulus between the riser string and a rotating drill string, and the rotating control device being removable from the riser string while the riser string interconnects the drilling rig to the wellhead.

2. The riser system of claim 1, further comprising a line in communication with the interior of the riser string below the rotating control device, and wherein a substance is injected into the riser string via the line so that the substance mixes with drilling fluid in the riser string and the mixed substance and drilling fluid has a density less than a density of the drilling fluid.

3. The riser system of claim 2, wherein the substance comprises Nitrogen gas.

4. The riser system of claim 2, wherein the substance comprises a relatively compressible fluid.

5. The riser system of claim 2, wherein the substance comprises glass spheres.

6. The riser system of claim 1, further comprising a line in communication with an interior of the riser string below the rotating control device, and a choke which variably restricts flow of drilling fluid from the interior of the riser string to the drilling rig, the choke being incorporated into the riser string remote from the drilling rig.

7. The riser system of claim 6, wherein the choke is automatically controllable in response to signals received from at least one sensor.

8. The riser system of claim 7, wherein the sensor is used to monitor pressure in a wellbore below the wellhead.

9. The riser system of claim 1, wherein the riser string is internally pressurized below the rotating control device.

10. The riser system of claim 1, further comprising an inner riser sealingly received in a second seal bore in the riser string below the rotating control device.

11. The riser system of claim 10, further comprising a line providing fluid communication between the drilling rig and an interior of the riser string longitudinally between the rotating control device and the inner riser.

12. A method of drilling offshore with a pressurized riser string, the method comprising the steps of:

constructing a section of riser tubing having at least one seal bore formed therein and at least one port which communicates with an interior of the riser tubing;

interconnecting the section of riser tubing in the riser string;

extending the riser string between a drilling rig and a subsea wellhead;

conveying a rotating control device through the riser string and into sealing engagement with the seal bore;

securing the rotating control device in the seal bore using a latching mechanism of the rotating control device; and pressurizing the riser string below the rotating control device while the rotating control device seals off an annulus between the riser string and a drill string therein.

13. The method of claim 12, wherein the step of conveying the rotating control device through the riser string is performed after the step of securing the riser string between the drilling rig and the wellhead.

14. The method of claim 12, wherein the step of conveying the rotating control device through the riser string is performed after at least partially drilling a wellbore below the wellhead.

15. The method of claim 12, further comprising the step of retrieving the rotating control device from the riser string while the riser string is secured between the drilling rig and the wellhead.

16. The method of claim 15, wherein the step of retrieving the rotating control device is performed after the step of conveying the rotating control device through the riser string.

17. The method of claim 15, further comprising the step of installing a protective sleeve in the seal bore after the step of retrieving the rotating control device from the riser string.

18. The method of claim 12, further comprising the step of retrieving a protective sleeve from the seal bore prior to the step of conveying the rotating control device through the riser string.

19. The method of claim 12, wherein the constructing step further comprises positioning the port longitudinally between two of the seal bores, the rotating control device being sealingly engaged with one of the seal bores in the conveying step, and further comprising the step of sealingly engaging an inner riser with the other seal bore.

20. The method of claim 12, further comprising the step of injecting a substance into an interior of the riser string via the port below the rotating control device, thereby mixing the substance with drilling fluid in the interior of the riser string, a density of the mixed drilling fluid and substance being less than a density of the drilling fluid prior to the mixing.

* * * * *